US011554898B2

(12) United States Patent
Brunner et al.

(10) Patent No.: US 11,554,898 B2
(45) Date of Patent: Jan. 17, 2023

(54) COUPLEABLE CRATE

(71) Applicants: KETER PLASTIC LTD., Herzliya (IL); MILWAUKEE ELECTRIC TOOL CORPORATION, Brookfield, WI (US)

(72) Inventors: Yaron Brunner, Kibbutz Gvat (IL); Omer Menashri, Kibbutz Afikim (IL); Grant T. Squiers, Cudahy, WI (US)

(73) Assignees: KETER PLASTIC LTD., Herzliya (IL); MILWAUKEE ELECTRIC TOOL CORPORATION, Brookfield, WI (US)

( * ) Notice: Subject to any disclaimer, the term of this patent is extended or adjusted under 35 U.S.C. 154(b) by 24 days.

(21) Appl. No.: 16/966,776

(22) PCT Filed: Jan. 31, 2019

(86) PCT No.: PCT/IL2019/050124
§ 371 (c)(1),
(2) Date: Jul. 31, 2020

(87) PCT Pub. No.: WO2019/150370
PCT Pub. Date: Aug. 8, 2019

(65) Prior Publication Data

US 2021/0039831 A1 Feb. 11, 2021

(30) Foreign Application Priority Data

Feb. 1, 2018 (IL) ..... 257294

(51) Int. Cl.
*B65D 21/02* (2006.01)
*B65D 25/28* (2006.01)
*B65D 25/20* (2006.01)

(52) U.S. Cl.
CPC ..... *B65D 21/0212* (2013.01); *B65D 25/20* (2013.01); *B65D 25/2885* (2013.01)

(58) Field of Classification Search
CPC ..... B65D 25/02; B65D 25/04; B65D 25/06; B65D 2501/24592; B65D 21/0212
See application file for complete search history.

(56) References Cited

U.S. PATENT DOCUMENTS 495,537 A 4/1893 Westerman
509,839 A 11/1893 Bowley
(Continued)

FOREIGN PATENT DOCUMENTS

CA 2 562 993 A1 4/2007
CN 2608238 Y 3/2004
(Continued)

OTHER PUBLICATIONS

Auer Packaging Jan. 2016 ("Auer-Catalog").
(Continued)

*Primary Examiner* — Andrew T Kirsch
(74) *Attorney, Agent, or Firm* — Vorys, Sater, Seymour and Pease LLP; Anthony P. Venturino; Maryellen Feehery Hank

(57) ABSTRACT

Provided is a crate coupleable to another crate or to a variety of carrying platforms. The crate having a base and side-walls upwardly extending from the base, of which at least two opposite side-walls are locking side-walls extending parallel to one another, each of the locking side-walls is configured at a top or a bottom surface thereof with at least one sliding locking slot extending parallel to said locking side-wall and defining a primary sliding path, the at least one sliding locking slot is configured with at least one arresting rib and an uncovered portion extending behind the at least one arresting rib, another one of the top or a bottom surface of
(Continued)

the locking side-walls is configured with at least one locking tongue disposed parallel to said locking side-wall and configured for sliding arresting with a respective locking slot.

22 Claims, 11 Drawing Sheets

(56) References Cited

U.S. PATENT DOCUMENTS 1,081,378 A 12/1913 Freeman
1,084,360 A 1/1914 Rahm
1,112,943 A 10/1914 Stone
1,488,460 A 3/1924 Scheer
1,704,480 A 3/1929 Kicileski
D85,986 S 1/1932 Myers
2,042,387 A 5/1936 High et al.
2,100,036 A 11/1937 Michal
2,103,106 A 12/1937 Yurkovitch
2,124,541 A 7/1938 Cassey
2,210,235 A 8/1940 Filbert
2,386,343 A 10/1945 Regenhardt
2,430,200 A 11/1947 Wilson
2,558,126 A 6/1951 Davenport
2,588,009 A 3/1952 Jones
2,939,613 A 6/1960 Herman et al.
2,970,358 A 2/1961 Elsner
3,005,282 A 10/1961 Christiansen
3,117,692 A 1/1964 Carpenter et al.
3,186,585 A 6/1965 Denny
3,225,865 A 12/1965 Downey
3,370,236 A 2/1968 Walker
3,423,786 A 1/1969 Arias, Jr. et al.
3,424,334 A 1/1969 Goltz
3,506,321 A 4/1970 Hampel
3,514,170 A 5/1970 Shewchuk
3,550,908 A 12/1970 Propst
3,552,817 A 1/1971 Marcolongo
3,567,298 A 3/1971 Ambaum et al.
3,743,372 A 7/1973 Ruggerone
D232,798 S 9/1974 Roche
3,835,623 A 9/1974 Kline
3,851,936 A 12/1974 Muller
3,935,613 A 2/1976 Kaneko
3,974,898 A 8/1976 Tullis et al.
3,999,818 A 12/1976 Schankler
4,043,566 A 8/1977 Johnson
4,122,925 A 10/1978 Schultheiss
4,168,076 A 9/1979 Johnson
4,243,279 A 1/1981 Ackeret
4,303,367 A 12/1981 Bott
4,491,231 A 1/1985 Heggeland et al.
4,524,985 A 6/1985 Drake
4,564,732 A 1/1986 Lancaster et al.
4,577,772 A 3/1986 Bigliardi
D285,986 S 10/1986 Huang
4,639,005 A 1/1987 Birkley
4,643,494 A * 2/1987 Marleau ..... A45C 5/00 292/120
4,660,725 A 4/1987 Fishman et al.
4,673,070 A 6/1987 Ambal
4,684,034 A 8/1987 Ono et al.
4,693,345 A 9/1987 Mittelmann
4,735,107 A 4/1988 Winkie
4,805,859 A 2/1989 Hudson
4,817,237 A 4/1989 Murphy
4,929,973 A 5/1990 Nakatani
4,971,201 A 11/1990 Sathre
5,035,389 A 7/1991 Wang
5,035,445 A 7/1991 Poulin
D319,016 S 8/1991 Kahl
5,098,235 A 3/1992 Svetlik
D325,324 S 4/1992 Kahl
5,105,947 A 4/1992 Wise
D326,815 S 6/1992 Meisner et al.
5,154,291 A 10/1992 Sur
5,240,264 A 8/1993 Williams
D340,167 S 10/1993 Kahl
5,282,554 A 2/1994 Thomas
5,301,829 A 4/1994 Chrisco
5,325,966 A 7/1994 Chang
5,356,038 A 10/1994 Banks
5,356,105 A 10/1994 Andrews
D352,208 S 11/1994 Brookshire
5,375,709 A 12/1994 Petro
5,429,235 A 7/1995 Chen
5,429,260 A 7/1995 Vollers
5,433,416 A 7/1995 Johnson
D361,511 S 8/1995 Dickinson et al.
5,454,634 A 10/1995 Herbst et al.
5,538,213 A 7/1996 Brown
5,595,228 A 1/1997 Meisner et al.
5,608,603 A 3/1997 Su
5,622,296 A 4/1997 Pirhonen et al.
5,628,443 A 5/1997 Deutsch
5,653,366 A 8/1997 Liserre
5,664,292 A 9/1997 Chen
D395,533 S 6/1998 Morison et al.
5,775,046 A 7/1998 Fanger et al.
5,797,617 A 8/1998 Lin
5,850,996 A 12/1998 Liang
5,890,613 A 4/1999 Williams
5,951,037 A 9/1999 Hsieh et al.
5,957,421 A 9/1999 Barbour
D415,393 S 10/1999 Kei
5,988,473 A 11/1999 Hagan et al.
D420,860 S 2/2000 Golichowski et al.
6,036,071 A 3/2000 Hartmann et al.
6,050,660 A 4/2000 Gurley
6,082,539 A 7/2000 Lee
6,082,687 A 7/2000 Kump et al.
6,085,925 A 7/2000 Chung
6,098,858 A 8/2000 Laugesen
6,109,627 A 8/2000 Be
6,123,344 A 9/2000 Clegg
6,131,926 A 10/2000 Harlan
6,132,819 A 10/2000 Ober et al.
6,176,558 B1 1/2001 Hlade et al.
6,176,559 B1 1/2001 Tiramani et al.
D437,484 S 2/2001 Tiramani et al.
D437,669 S 2/2001 Blason et al.
6,305,498 B1 10/2001 Itzkovitch
6,311,881 B1 11/2001 Kamiya
6,347,847 B1 2/2002 Tiramani et al.
6,354,759 B1 3/2002 Leicht
6,367,631 B1 4/2002 Steigerwald
6,371,320 B2 4/2002 Sagol
6,371,321 B1 4/2002 Lee
6,371,424 B1 4/2002 Shaw
D456,972 S 5/2002 Blason et al.
6,431,580 B1 8/2002 Kady
6,497,395 B1 12/2002 Croker
6,547,347 B2 4/2003 Saito et al.
6,601,930 B2 8/2003 Tiramani et al.
6,619,772 B2 9/2003 Dierbeck
6,637,707 B1 10/2003 Gates et al.
6,641,013 B2 11/2003 Dise
6,666,362 B1 12/2003 Letrudet
6,889,838 B2 5/2005 Meier et al.
6,945,546 B2 9/2005 Guirlinger
6,948,691 B2 9/2005 Brock et al.
6,983,946 B2 1/2006 Sullivan et al.
7,007,903 B2 3/2006 Turner
7,044,484 B2 5/2006 Wang
7,066,475 B2 6/2006 Barnes
7,077,372 B2 7/2006 Moran
D525,789 S 8/2006 Hosking
D527,225 S 8/2006 Krieger et al.
7,083,061 B2 8/2006 Spindel et al.
7,090,085 B1 8/2006 Mcendese et al.
7,121,417 B2 10/2006 Magnusson et al.
7,147,243 B2 12/2006 Kady
7,152,752 B2 12/2006 Kurtenbach
D536,580 S 2/2007 Krieger et al.

(56) References Cited

U.S. PATENT DOCUMENTS

| | | | |
|---|---|---|---|
| 7,172,164 | B2 | 2/2007 | Fuelling et al. |
| 7,219,969 | B2 | 5/2007 | Bezzubov |
| D545,697 | S | 7/2007 | Martin |
| 7,263,742 | B2 | 9/2007 | Valentini |
| 7,350,648 | B2 | 4/2008 | Gerstner et al. |
| 7,367,571 | B1 | 5/2008 | Nichols |
| 7,431,172 | B1 | 10/2008 | Spindel et al. |
| 7,448,115 | B2 | 11/2008 | Howell et al. |
| 7,490,800 | B2 | 2/2009 | Tu |
| 7,503,569 | B2 | 3/2009 | Duvigneau |
| 7,658,887 | B2 | 2/2010 | Hovatter |
| 7,690,856 | B2 | 4/2010 | Mortensen |
| 7,757,913 | B2 | 7/2010 | Fichera |
| 7,779,764 | B2 | 8/2010 | Naidu et al. |
| 7,780,026 | B1 | 8/2010 | Zuckerman |
| D627,967 | S | 11/2010 | Kuhls |
| 7,837,165 | B2 | 11/2010 | Stone |
| 7,841,144 | B2 | 11/2010 | Pervan |
| D630,851 | S | 1/2011 | Landau et al. |
| 8,028,845 | B2 | 10/2011 | Himes |
| D649,350 | S | 11/2011 | Shitrit |
| D649,783 | S | 12/2011 | Brunner |
| D653,832 | S | 2/2012 | Vilkomirski et al. |
| 8,132,819 | B2 | 3/2012 | Landau et al. |
| 8,177,463 | B2 | 5/2012 | Walker |
| D661,858 | S | 6/2012 | Lifshitz et al. |
| 8,191,910 | B2 | 6/2012 | Landau et al. |
| D663,952 | S | 7/2012 | Crevling, Jr. et al. |
| D664,354 | S | 7/2012 | Crevling, Jr. et al. |
| D668,869 | S | 10/2012 | Yamamoto et al. |
| 8,292,244 | B2 | 10/2012 | Okada |
| D674,605 | S | 1/2013 | Vilkomirski et al. |
| 8,448,829 | B2 | 5/2013 | Watanabe |
| 8,454,033 | B2 | 6/2013 | Tsai |
| 8,459,495 | B2 | 6/2013 | Koenig et al. |
| 8,505,729 | B2 | 8/2013 | Sosnovsky et al. |
| 8,567,796 | B2 | 10/2013 | Bar-Erez et al. |
| 8,602,217 | B2 | 12/2013 | Sosnovsky et al. |
| 8,640,913 | B2 | 2/2014 | Berendes |
| 8,677,661 | B2 | 3/2014 | Michels et al. |
| D701,696 | S | 4/2014 | Shitrit et al. |
| 8,689,396 | B2 | 4/2014 | Wolfe et al. |
| 8,714,355 | B2 | 5/2014 | Huang |
| 8,813,960 | B2 | 8/2014 | Fjelland |
| 8,851,282 | B2 | 10/2014 | Brunner |
| 8,875,888 | B2 | 11/2014 | Koenig et al. |
| 8,894,160 | B1 | 11/2014 | Christensen |
| 8,924,752 | B1 | 12/2014 | Law et al. |
| 8,925,752 | B2 | 1/2015 | Smith |
| 8,979,100 | B2 | 3/2015 | Bensman et al. |
| 8,985,922 | B2 | 3/2015 | Neumann |
| D738,105 | S | 9/2015 | Shitrit |
| D738,106 | S | 9/2015 | Shitrit |
| D738,622 | S | 9/2015 | Sabbag et al. |
| 9,132,543 | B2 | 9/2015 | Bar-Erez et al. |
| D753,394 | S | 4/2016 | Brunner |
| D753,395 | S | 4/2016 | Brunner |
| D753,396 | S | 4/2016 | Brunner |
| D753,982 | S | 4/2016 | Guirlinger |
| D765,974 | S | 9/2016 | Tonelli et al. |
| D770,179 | S | 11/2016 | Menirom |
| 9,506,489 | B2 | 11/2016 | Ko |
| 9,511,491 | B2 | 12/2016 | Brunner |
| D777,426 | S | 1/2017 | Dahl |
| 9,551,367 | B1 | 1/2017 | Shieh |
| 9,566,990 | B2 | 2/2017 | Bar-Erez et al. |
| D784,089 | S | 4/2017 | Furneaux et al. |
| 9,616,562 | B2 | 4/2017 | Hoppe et al. |
| 9,643,629 | B2 | 5/2017 | Bar-Erez et al. |
| D790,221 | S | 6/2017 | Yahav et al. |
| 9,701,443 | B2 | 7/2017 | Wang |
| 9,725,209 | B1 | 8/2017 | Ben-Gigi |
| D803,631 | S | 11/2017 | Min et al. |
| 9,850,029 | B2 | 12/2017 | Brunner |
| D806,483 | S | 1/2018 | Stanford et al. |
| 9,872,562 | B2 | 1/2018 | Brunner |
| 9,888,752 | B2 | 2/2018 | Den Boer et al. |
| D814,187 | S | 4/2018 | Caglar |
| D815,831 | S | 4/2018 | Tonelli |
| D816,334 | S | 5/2018 | Brunner |
| 10,017,134 | B2 | 7/2018 | Pickens et al. |
| D826,510 | S | 8/2018 | Brunner |
| RE47,022 | E | 9/2018 | Sosnovsky et al. |
| D828,671 | S | 9/2018 | Cope et al. |
| D831,352 | S | 10/2018 | Brunner |
| 10,106,180 | B2 | 10/2018 | Bar-Erez et al. |
| D833,744 | S | 11/2018 | Yahav et al. |
| D836,995 | S | 1/2019 | Carey et al. |
| D837,515 | S | 1/2019 | Shpitzer |
| D839,681 | S | 2/2019 | Evron et al. |
| 10,222,172 | B2 | 3/2019 | Melville |
| D845,080 | S | 4/2019 | Jacobsen et al. |
| D845,081 | S | 4/2019 | Jacobsen |
| 10,336,359 | B1 | 7/2019 | Asbille |
| D857,387 | S | 8/2019 | Shpitzer |
| 10,406,387 | B2 | 9/2019 | Krepel et al. |
| 10,434,638 | B1 | 10/2019 | Tsai |
| D871,013 | S | 12/2019 | Liu |
| D873,085 | S | 1/2020 | Defrancia |
| D876,833 | S | 3/2020 | Brunner et al. |
| 10,583,962 | B2 | 3/2020 | Brunner |
| 10,593,962 | B2 | 3/2020 | Herchen et al. |
| 10,603,783 | B2 | 3/2020 | Brocket et al. |
| D880,252 | S | 4/2020 | Jacobsen |
| D880,951 | S | 4/2020 | Jacobsen |
| D883,752 | S | 5/2020 | Carey et al. |
| D887,788 | S | 6/2020 | Meda et al. |
| D888,422 | S | 6/2020 | Yang |
| D888,503 | S | 6/2020 | Meda et al. |
| D891,193 | S | 7/2020 | Stanford et al. |
| D891,195 | S | 7/2020 | Zhou |
| 10,703,534 | B2 | 7/2020 | Brunner et al. |
| D891,875 | S | 8/2020 | Olson |
| D892,565 | S | 8/2020 | Astle et al. |
| D895,375 | S | 8/2020 | Astle et al. |
| 10,750,833 | B2 | 8/2020 | Burchia |
| D895,966 | S | 9/2020 | Brunner |
| D895,967 | S | 9/2020 | Brunner |
| D896,517 | S | 9/2020 | Brunner et al. |
| D896,518 | S | 9/2020 | Brunner et al. |
| D897,103 | S | 9/2020 | Brunner et al. |
| 10,758,065 | B2 | 9/2020 | Penalver, Jr. |
| D898,320 | S | 10/2020 | Brunner et al. |
| 10,793,172 | B2 | 10/2020 | Brunner |
| 10,829,268 | B2 | 11/2020 | Sommer |
| 10,829,269 | B2 | 11/2020 | Gonitianer et al. |
| 10,894,314 | B2 | 1/2021 | Hocine et al. |
| 10,933,501 | B2 | 3/2021 | Bisson |
| 10,962,218 | B2 | 3/2021 | Plato |
| 10,981,696 | B2 | 4/2021 | Brunner et al. |
| D917,977 | S | 5/2021 | Brunner et al. |
| D918,584 | S | 5/2021 | Brunner et al. |
| D919,296 | S | 5/2021 | Brunner et al. |
| 11,008,136 | B2 | 5/2021 | Brunner et al. |
| D920,671 | S | 6/2021 | Brunner et al. |
| D923,935 | S | 7/2021 | Brunner et al. |
| 11,059,631 | B1 | 7/2021 | Brunner et al. |
| 11,066,089 | B2 | 7/2021 | Brunner |
| D932,186 | S | 10/2021 | Brunner et al. |
| 11,155,382 | B1 | 10/2021 | Cai |
| D936,030 | S | 11/2021 | Lee et al. |
| D941,020 | S | 1/2022 | Brunner et al. |
| 11,230,410 | B2 | 1/2022 | Brunner |
| 11,283,117 | B2 | 3/2022 | Polakowski et al. |
| 11,464,335 | B2 | 10/2022 | Brunner et al. |
| 2002/0000440 | A1 | 1/2002 | Sagol |
| 2002/0030425 | A1 | 3/2002 | Tiramani et al. |
| 2002/0125072 | A1 | 9/2002 | Levy |
| 2002/0171228 | A1 | 11/2002 | Kady |
| 2003/0075468 | A1 | 4/2003 | Story et al. |
| 2003/0094392 | A1 | 5/2003 | Meier et al. |
| 2003/0094393 | A1 | 5/2003 | Sahm |
| 2003/0115715 | A1 | 6/2003 | Valentini |
| 2003/0146589 | A1 | 8/2003 | Jarko et al. |

(56) References Cited

U.S. PATENT DOCUMENTS

2003/0184034 A1 10/2003 Pfeiffer
2003/0205877 A1 11/2003 Verna et al.
2004/0074725 A1 4/2004 Shih
2004/0103494 A1 6/2004 Valentini
2004/0149754 A1 8/2004 Diamant
2004/0195793 A1 10/2004 Sullivan et al.
2004/0206656 A1 10/2004 Dubois et al.
2004/0256529 A1 12/2004 Richter
2005/0015928 A1 1/2005 Arsenault et al.
2005/0062244 A1 3/2005 Guirlinger
2005/0082775 A1 4/2005 Slager
2005/0104308 A1 5/2005 Barnes
2005/0139745 A1 6/2005 Liao et al.
2005/0242144 A1 11/2005 Panosian et al.
2006/0006770 A1 1/2006 Valentini
2006/0027475 A1 2/2006 Gleason et al.
2006/0038367 A9 2/2006 Ferraro et al.
2006/0076261 A1 4/2006 Kurtenbach
2006/0113303 A1 6/2006 Huruta
2006/0119060 A1 6/2006 Sullivan et al.
2006/0165482 A1 7/2006 Olberding
2006/0186624 A1 8/2006 Kady
2006/0254946 A1 11/2006 Becklin
2007/0006542 A1 1/2007 Duke
2007/0012694 A1 1/2007 Duvigneau
2007/0045505 A1 3/2007 Chen
2007/0068757 A1 3/2007 Tan
2007/0090616 A1 4/2007 Tompkins
2007/0145700 A1 6/2007 Ambrose et al.
2007/0194543 A1 8/2007 Duvigneau
2007/0273114 A1 11/2007 Katz
2008/0060953 A1 3/2008 Ghassan
2008/0104921 A1 5/2008 Pervan et al.
2008/0115312 A1 5/2008 DiPasquale et al.
2008/0121547 A1 5/2008 Dur et al.
2008/0134607 A1 6/2008 Pervan et al.
2008/0136133 A1 6/2008 Takahashi
2008/0169739 A1 7/2008 Goldenberg
2008/0271280 A1 11/2008 Tiede et al.
2008/0277221 A1 11/2008 Josefson et al.
2008/0280523 A1 11/2008 Bishop
2008/0296443 A1 12/2008 Lunitz et al.
2008/0308369 A1 12/2008 Louis, Sr.
2009/0026901 A1 1/2009 Nies, III et al.
2009/0071990 A1 3/2009 Jardine et al.
2009/0127146 A1 5/2009 Krebs et al.
2009/0145790 A1 6/2009 Panosian et al.
2009/0145866 A1 6/2009 Panosian et al.
2009/0145913 A1 6/2009 Panosian et al.
2009/0178946 A1 7/2009 Patsone et al.
2009/0236482 A1 9/2009 Winig et al.
2009/0288970 A1 11/2009 Katz et al.
2010/0052276 A1 3/2010 Brunner
2010/0139566 A1 6/2010 Lopuszanski
2010/0147642 A1 6/2010 Andochick
2010/0176261 A1 7/2010 Chen et al.
2010/0219193 A1 9/2010 Becklin
2010/0224528 A1 9/2010 Madsen
2010/0290877 A1 11/2010 Landau et al.
2011/0049824 A1 3/2011 Bar-Erez et al.
2011/0073516 A1 3/2011 Zelinskiy
2011/0139665 A1 6/2011 Madsen
2011/0139777 A1 6/2011 Sosnovsky et al.
2011/0155613 A1 6/2011 Koenig et al.
2011/0174939 A1 7/2011 Taylor
2011/0181008 A1 7/2011 Bensman et al.
2011/0220531 A1 9/2011 Meether et al.
2012/0073995 A1 3/2012 Parker
2012/0074022 A1 3/2012 McTavish
2012/0074158 A1 3/2012 Lafleur
2012/0080432 A1 4/2012 Bensman et al.
2012/0152800 A1 6/2012 Parzy et al.
2012/0152944 A1 6/2012 Vilkomirski et al.
2012/0160886 A1 6/2012 Henny et al.
2012/0180250 A1 7/2012 Ricklefsen et al.
2012/0207571 A1 8/2012 Scott
2012/0292213 A1 11/2012 Brunner
2012/0326406 A1 12/2012 Lifshitz et al.
2013/0024468 A1 1/2013 Kocsis
2013/0031731 A1 2/2013 Hess
2013/0031732 A1 2/2013 Hess et al.
2013/0056462 A1* 3/2013 Furuta ..... B65D 21/0202 220/23.4
2013/0068903 A1 3/2013 O'Keene
2013/0121783 A1 5/2013 Kelly
2013/0127129 A1 5/2013 Bensman et al.
2013/0146551 A1 6/2013 Simpson et al.
2013/0154218 A1 6/2013 Tiilikaninen
2013/0206139 A1 8/2013 Krepel et al.
2013/0223971 A1 8/2013 Grace, IV
2014/0062042 A1 3/2014 Wagner et al.
2014/0069832 A1 3/2014 Roehm
2014/0076759 A1 3/2014 Roehm et al.
2014/0123478 A1 5/2014 Gylander et al.
2014/0161518 A1 6/2014 Ko
2014/0166516 A1 6/2014 Martinez et al.
2014/0197059 A1 7/2014 Evans et al.
2015/0014949 A1 1/2015 Dittman
2015/0034515 A1 2/2015 Monyak et al.
2015/0151427 A1 6/2015 Ben-Gigi
2015/0274362 A1 10/2015 Christopher et al.
2015/0310842 A1 10/2015 Coburn et al.
2015/0376917 A1 12/2015 Brunner
2016/0023349 A1 1/2016 Hoppe et al.
2016/0130034 A1 5/2016 Kuhls et al.
2016/0144500 A1 5/2016 Chen
2016/0168880 A1 6/2016 Phelan
2016/0213115 A1 7/2016 Gonitianer et al.
2016/0221177 A1 8/2016 Reinhart
2017/0065355 A1 3/2017 Ross et al.
2017/0098513 A1 4/2017 Horvath et al.
2017/0121056 A1 5/2017 Wang
2017/0138382 A1 5/2017 Ko
2017/0158216 A1 6/2017 Yahav et al.
2017/0165828 A1 6/2017 Fleischmann
2017/0166352 A1 6/2017 Hoppe et al.
2017/0174392 A1 6/2017 De Loynes
2017/0217464 A1 8/2017 Bar-Erez et al.
2017/0239808 A1 8/2017 Hoppe et al.
2017/0257958 A1 9/2017 Sabbag et al.
2017/0266804 A1 9/2017 Kinskey
2017/0318927 A1 11/2017 Kraus et al.
2017/0349013 A1 12/2017 Gronholm
2018/0000234 A1 1/2018 White
2018/0044059 A1 2/2018 Brunner
2018/0099405 A1 4/2018 Reinhart
2018/0127007 A1 5/2018 Kravchenko
2018/0153312 A1 6/2018 Buck et al.
2018/0161975 A1 6/2018 Brunner
2018/0186513 A1 7/2018 Brunner
2018/0213934 A1 8/2018 Wolle et al.
2018/0220758 A1 8/2018 Burchia
2018/0229889 A1 8/2018 Li
2018/0290288 A1 10/2018 Brunner
2018/0290289 A1 10/2018 Reinhart
2019/0001482 A1 1/2019 Wolle et al.
2019/0002004 A1 1/2019 Brunner
2019/0031222 A1 1/2019 Takyar et al.
2019/0039781 A1 2/2019 Kogel et al.
2019/0106244 A1 4/2019 Brunner et al.
2019/0168376 A1 6/2019 Brocket et al.
2019/0225371 A1 7/2019 Hoppe et al.
2019/0225374 A1 7/2019 McCrea et al.
2020/0029543 A1 1/2020 Householder
2020/0055534 A1 2/2020 Hassell
2020/0078929 A1 3/2020 Liu
2020/0147781 A1 5/2020 Squiers
2020/0165036 A1 5/2020 Squiers
2020/0223585 A1 7/2020 Brunner et al.
2020/0243925 A1 7/2020 Polakowski et al.
2020/0299027 A1 9/2020 Brunner et al.
2020/0346819 A1 11/2020 Kogel
2021/0025706 A1 1/2021 Millane
2021/0031975 A1 2/2021 Brunner

(56) References Cited

U.S. PATENT DOCUMENTS

| | | | |
|---|---|---|---|
| 2021/0039831 | A1 | 2/2021 | Brunner |
| 2021/0094600 | A1 | 4/2021 | Brunner et al. |
| 2021/0104909 | A1 | 4/2021 | Mantych |
| 2021/0155373 | A1 | 5/2021 | Cai |
| 2021/0187725 | A1 | 6/2021 | Brunner |
| 2021/0221561 | A1 | 7/2021 | Davidian et al. |
| 2021/0267368 | A1 | 9/2021 | Bruins |
| 2021/0316909 | A1 | 10/2021 | Vargo et al. |

FOREIGN PATENT DOCUMENTS

| | | | |
|---|---|---|---|
| CN | 2782508 | Y | 5/2006 |
| CN | 200947356 | Y | 9/2007 |
| CN | 101068661 | A | 11/2007 |
| CN | 101821148 | A | 9/2010 |
| CN | 102042354 | A | 5/2011 |
| CN | 102137795 | A | 7/2011 |
| CN | 102248523 | A | 11/2011 |
| CN | 102469899 | A | 5/2012 |
| CN | 101362464 | B | 7/2012 |
| CN | 102608238 | A | 7/2012 |
| CN | 102834035 | A | 12/2012 |
| CN | 302371147 | S | 3/2013 |
| CN | 103118578 | A | 5/2013 |
| CN | 103659777 | A | 3/2014 |
| CN | 102186714 | B | 1/2015 |
| CN | 204161752 | U | 2/2015 |
| CN | 204701903 | U | 10/2015 |
| CN | 106231909 | A | 12/2016 |
| DE | 3510307 | A1 | 9/1986 |
| DE | 9313802 | U1 | 12/1993 |
| DE | 4415638 | A1 | 11/1995 |
| DE | 29708343 | U1 | 7/1997 |
| DE | 19750543 | A1 | 5/1999 |
| DE | 20218996 | U1 | 3/2003 |
| DE | 102004057870 | A1 | 6/2006 |
| DE | 202011002617 | U1 | 4/2011 |
| DE | 102010003754 | A1 | 10/2011 |
| DE | 102010003756 | A1 | 10/2011 |
| DE | 102012106482 | A1 | 1/2014 |
| DE | 102012220837 | A1 | 5/2014 |
| DE | 202014103695 | U1 | 12/2014 |
| DE | 202015105053 | U1 | 10/2016 |
| DE | 202015005752 | U1 | 11/2016 |
| DE | 102015112204 | A1 | 2/2017 |
| DE | 102015013053 | A1 | 4/2017 |
| DE | 402018201520 | | 11/2018 |
| EM | 000705231-0001 | | 4/2007 |
| EM | 002419283-0001 | | 3/2014 |
| EP | 0916302 | A2 | 5/1999 |
| EP | 1321247 | A2 | 6/2003 |
| EP | 1428764 | B1 | 6/2006 |
| EP | 1819487 | A1 | 8/2007 |
| EP | 1925406 | A1 | 5/2008 |
| EP | 2289671 | A2 | 3/2011 |
| EP | 2346741 | A1 | 7/2011 |
| EP | 2456341 | A1 | 5/2012 |
| EP | 2 543 297 | A2 | 1/2013 |
| EP | 2555660 | A2 | 2/2013 |
| EP | 2555661 | A1 | 2/2013 |
| EP | 2805799 | A2 | 11/2014 |
| EP | 3141354 | A1 | 3/2017 |
| FR | 3 043 970 | A | 5/2017 |
| GB | 694707 | A | 7/1953 |
| GB | 2047181 | B | 2/1983 |
| GB | 2110076 | A | 6/1983 |
| GB | 2330521 | A | 4/1999 |
| GB | 2406331 | A | 3/2005 |
| GB | 2413265 | A | 10/2005 |
| GB | 2449934 | A | 12/2008 |
| IL | 255989 | B | 7/2022 |
| JP | 2003194020 | A | 7/2003 |
| JP | D1180963 | S | 8/2003 |
| JP | 1276744 | S | 7/2006 |
| JP | D1395115 | S | 8/2010 |
| JP | D1395116 | S | 8/2010 |
| JP | D1455321 | S | 11/2012 |
| JP | 2013022972 | A | 2/2013 |
| JP | 2013022976 | A | 2/2013 |
| JP | 1477050 | S | 8/2013 |
| JP | 2014-117961 | A | 6/2014 |
| JP | D1503434 | S | 7/2014 |
| JP | 2017-218191 | A | 12/2017 |
| JP | D1625407 | S | 2/2019 |
| JP | D1665028 | S | 8/2020 |
| KR | 300271616 | | 2/2000 |
| KR | 300320243 | | 6/2002 |
| KR | 300806604 | | 7/2015 |
| KR | 300842236 | | 3/2016 |
| KR | 300849600 | | 4/2016 |
| KR | 300859965 | | 6/2016 |
| KR | 3008881296 | | 11/2016 |
| KR | 300999599 | | 3/2019 |
| TW | I324578 | B | 5/2010 |
| TW | D135074 | S | 6/2010 |
| TW | D168686 | S | 7/2015 |
| TW | D174412 | S1 | 3/2016 |
| TW | D192092 | | 8/2018 |
| TW | D206875 | | 9/2020 |
| WO | 2005045886 | A2 | 5/2005 |
| WO | 2006099638 | A1 | 9/2006 |
| WO | 2007121745 | A1 | 11/2007 |
| WO | 2007121746 | A2 | 11/2007 |
| WO | 2008/090546 | A1 | 7/2008 |
| WO | 2009140965 | A1 | 11/2009 |
| WO | 2011/000387 | A1 | 1/2011 |
| WO | 2011009480 | A1 | 1/2011 |
| WO | 2011/032568 | A1 | 3/2011 |
| WO | 2013026084 | A1 | 2/2013 |
| WO | 2014125488 | A2 | 8/2014 |
| WO | 2016142935 | A1 | 9/2016 |
| WO | 2016/187652 | A1 | 12/2016 |
| WO | 2017028845 | A1 | 2/2017 |
| WO | 2017098513 | A1 | 6/2017 |
| WO | 2017191628 | A1 | 11/2017 |
| WO | 2017212840 | A1 | 12/2017 |
| WO | 2018/213560 | A1 | 11/2018 |
| WO | 2019/028041 | A1 | 2/2019 |

OTHER PUBLICATIONS

Auer Packaging Feb. 2016.

Amazon. Hopkins FloTool 91002 Thino Box with Mount, https://www.amazon.com/exec/obidos/ASIN/B003K15F31/20140000-20, accessed Jun. 17, 2019.

Batavia Gmbh. BluCave Storage System. https://protect-us.mimecast.com/s/5XIGCR6KypcgJnIKi9EDoim?domain=batavia.eu, accessed Jun. 17, 2019.

Batavia. BluCave Universal Storage System, https://batavia.eu/blucave-storage-system/, accessed Jun. 17, 2019.

BluCave Video?. https://www.youtube.com/watch?v=Sw7fQQPw0tY&feature=youtu.be&t=32.

Cain, Tristan. "Bird Balder, er—Builder." Brick Journal, Nov. 2013 (Issue 26), pp. 15-16.

"Cavity". Merriam-Webster's Collegiate Dictionary (11th Ed.), Merriam-Webster, Incorporated, 2020, p. 197.

Certified Translations of the Cover Pages of DE102015112204A1 and DE202015105053U1.

Final Rejection dated Nov. 28, 2018 in U.S. Appl. No. 15/826,201 (17 Pages).

Forum Post: Systainer clone (dated Feb. 15, 2016).

General Design Principles for DuPont Engineering Polymers, E.I. du Porn de Nemours and Company, 2000.

Get Tools Direct. TSTAC Vac Rack (Suits DWV902M & DWV900L) DwV9500-XJ, https://www.gettoolsdirect.com.au/dewalt-tstak-vac-rack-suits-dwv902m-and-dwv9001-dwv9500-xj.html, accessed Jun. 17, 2019.

International Search Report and Written Opinion for International Application No. PCT/US2018/044629, dated Jan. 9, 2019.

International Search Report and Written Opinion for International Application No. PCT/US2018/033161, dated Aug. 6, 2018 (14 pages).

(56) References Cited

OTHER PUBLICATIONS

Its. Dewalt 171229 Dewait TSTAK Carrier Trolley, https://www.its.co.uk/pd/171229-Dewalt-TSTAK-Carrier-Trolley-_DEW171229.htm, accessed Jun. 17, 2019.
Kazmer, David. "Design of Plastic Parts." Applied Plastics Engineering Handbook Processing and Materials, edited by Myer Kutz, Elsevier Inc., 2011, pp. 535-551.
Milwaukee Dolly, announced 2019 (online), (site visited Mar. 9, 2020). Available from internet, URL: https://www.zoro.com/milwaukee-tool-box-dolly-7-4164-h-18-2932-W-48-22-8410/i/G3958724/ (Year: 2019).
Messetermine 2016 (dated Feb. 18, 2016), Wayback machine archive (dated Apr. 4, 2016), Auer Packaging 1111 In- and Ausland present (dated Feb. 2016), and photograph, with certified translations.
Neue Produktfamilie: Systemboxen Durchdacht, Komfortabfi Und In Wertigem Design (dated Oct. 19, 2015), Wayback machine archive (dated Dec. 16, 2015), Auer Packaging prSsentiert neue Produktfamilie Systernboxen (dated Sep. 2015), and images ("Auer-Press"), with certified translations.
Nugent, Paul. "Rotational Molding," Applied Plastics Engineering Handbook Processing and Materials, edited by Myer Kutz, Elsevier Inc., 2011, pp. 311-332.
Sortimo Logistbm Sortimo International GmbH, Mobile Sortimente, http://p125638.mittwaldserver.info/fileadmin/media/PDFs/Logistixx_Broschuere_DE_WEB.pdf, accessed Jun. 17, 2019.
'Structure Design', Design Solutions Guide, BASF Corporation. 2007.
The Greenhead. Blitz Box—Portable Storage Box/Shelf, https://www.thegreenhead.com/2013/03/blitz-box-portable-storage-box-shelf.php, accessed Jun. 17, 2019.
ToolGuyd. Ryobi ToolBlox Tool Cabinet System, https://toolguyd.com/ryobi-toolblox-cabinets/, accessed Jun. 17, 2019.
Vertak. https://www.alibaba.com/product-detail/Vertak-global-patented-multi-funciton-portable_60217794260.html.
Wheel board, announced 2019 (online), (site visited Mar. 9, 2020). Available from internet, URL: https://www.gearooz.com accu-case-aca-wheel-board (Year: 2019).
Youtube. TSTAK Phase 2 Upgrades Video. https://www.youtube.com/watch?v=jb06y6J1dr4&feature=youtu.be&t=197, accessed Jun. 17, 2019.
Extended European search report for application No. 18892505.1 dated Sep. 17, 2021 (7 Pages).
International Search Report and Written Opinion for International Application No. PCT/US2019/014940, dated Jul. 26, 2019 (7 pages).
International Search Report for International Application No. PCT/IL2019/050689, dated Aug. 23, 2019 (21 pages).
International Search Report for International Application No. PCT/IL2020/050433, dated Jun. 21, 2020 (14 pages).
Inter Partes Review No. 2021-00373, "Petition for Inter Partes Review of U.S. Pat. No. 10,583,962" filed Jan. 5, 2021, 198 pages.
Exhibit 1001 in Petition for Inter Partes Review of U.S. Pat. No. 10,583,962, filed Jan. 5, 2021, 64 Pages.
Exhibit 1002 in Petition for Inter Partes Review of U.S. Pat. No. 10,583,962, filed Jan. 5, 2021, 75 Pages.
Exhibit 1003 in Petition for Inter Partes Review of U.S. Pat. No. 10,583,962, filed Jan. 5, 2021, 13 Pages.
Exhibit 1004 in Petition for Inter Partes Review of U.S. Pat. No. 10,583,962, filed Jan. 5, 2021, 18 Pages.
Exhibit 1005 in Petition for Inter Partes Review of U.S. Pat. No. 10,583,962, filed Jan. 5, 2021, 9 Pages.
Exhibit 1006 in Petition for Inter Partes Review of U.S. Pat. No. 10,583,962, filed Jan. 5, 2021, 176 Pages.
Exhibit 1007 in Petition for Inter Partes Review of U.S. Pat. No. 10,583,962, filed Jan. 5, 2021, 22 Pages.
Exhibit 1008 in Petition for Inter Partes Review of U.S. Pat. No. 10,583,962, filed Jan. 5, 2021, 6 Pages.
Exhibit 1009 in Petition for Inter Partes Review of U.S. Pat. No. 10,583,962, filed Jan. 5, 2021, 24 Pages.
Exhibit 1010 in Petition for Inter Partes Review of U.S. Pat. No. 10,583,962, filed Jan. 5, 2021, 19 Pages.
Exhibit 1011 in Petition for Inter Partes Review of U.S. Pat. No. 10,583,962, filed Jan. 5, 2021, 26 Pages.
Exhibit 1012 in Petition for Inter Partes Review of U.S. Pat. No. 10,583,962, filed Jan. 5, 2021, 3 Pages.
Exhibit 1013 in Petition for Inter Partes Review of U.S. Pat. No. 10,583,962, filed Jan. 5, 2021, 168 Pages.
Exhibit 1014 in Petition for Inter Partes Review of U.S. Pat. No. 10,583,962, filed Jan. 5, 2021, 481 Pages.
Exhibit 1015 in Petition for Inter Partes Review of U.S. Pat. No. 10,583,962, filed Jan. 5, 2021, 6 Pages.
Exhibit 1016 in Petition for Inter Partes Review of U.S. Pat. No. 10,583,962, filed Jan. 5, 2021, 242 Pages.
Exhibit 1017 in Petition for Inter Partes Review of U.S. Pat. No. 10,583,962, filed Jan. 5, 2021, 6 Pages.
Exhibit 1018 in Petition for Inter Partes Review of U.S. Pat. No. 10,583,962, filed Jan. 5, 2021, 250 Pages.
Exhibit 1019 in Petition for Inter Partes Review of U.S. Pat. No. 10,583,962, filed Jan. 5, 2021, 44 Pages.
Exhibit 1020 in Petition for Inter Partes Review of U.S. Pat. No. 10,583,962, filed Jan. 5, 2021, 5 Pages.
Exhibit 1021 in Petition for Inter Partes Review of U.S. Pat. No. 10,583,962, filed Jan. 5, 2021, 1 Pages.
Exhibit 1022 in Petition for Inter Partes Review of U.S. Pat. No. 10,583,962, filed Jan. 5, 2021, 1 Pages.
Exhibit 1023 in Petition for Inter Partes Review of U.S. Pat. No. 10,583,962, filed Jan. 5, 2021, 24 Pages.
Exhibit 1024 in Petition for Inter Partes Review of U.S. Pat. No. 10,583,962, filed Jan. 5, 2021, 28 Pages.
Non-Final Rejection issued Jan. 24, 2019, in U.S. Appl. No. 16/216,724 (17 Pages).
Non-Final Rejection issued Apr. 12, 2018, in U.S. Appl. No. 15/826,201 (16 Pages).
Toolguyd, Sys-Cart Base, a Systainer Mounting Platform: wall and base support, 2014, 9 pages.

* cited by examiner

COUPLEABLE CRATE

TECHNOLOGICAL FIELD

The present disclosure is concerned with a crate coupleable to another crate or to a variety of carrying platforms.

BACKGROUND ART

References considered to be relevant as background to the presently disclosed subject matter are listed below:

DE102015112204

WO2017191628

EP2346741

Acknowledgement of the above references herein is not to be inferred as meaning that these are in any way relevant to the patentability of the presently disclosed subject matter.

BACKGROUND

EP2346741 discloses a storage arrangement comprising two or more cases or a case and a lid, all parts that can be stacked and interconnected and where the cases or lids have opposite facing gables and where a connecting bridge is placed in the four corners or with one connecting bridge on each of the opposite facing gables, wherein each connecting bridge is provided with a top bridge on top and with a bottom bridge on the bottom, whereby in the interconnected state of the parts the bottom bridge of the upper case or lid interconnects with the top bridge of the below case or lid, wherein the bottom bridge of the top case or lid is shaped as a male part having a downward pointing L profile which interconnects with the top bridge of the below case which is shaped as a female part also having an L profile, characterized in, that the L profiles of the top bridges and of the bottom bridges have the same lateral orientation such that when the bottom bridges of the top case or lid are placed above the opposite top bridges of the lower case or lid they will get in gear and with a sidewards push on the top case or lid be brought into a tight and compact condition, and that a transport lock is provided on the case or lid for blocking disassembly and keeping the top bridges and bottom bridges in tight and compact coupling, such transport lock being able to be activated outside the case or lid by a locking knob.

DE102015112204 discloses a stackable container for forming a container stack along a vertical stacking axis comprising a plurality of stackable containers with a body having at least one container bottom and a container cover, wherein the body belongs to forming a connecting device on the bottom side connecting elements which are designed to cooperate with counter-connecting elements in the region of the container ceiling of a second stackable container and the container has a locking device with respect to the body movably mounted locking element for cooperation with an anti-locking element of the second stackable container, characterized in that in each case the connecting elements and the mating connecting elements immovable with respect to the body are formed and the connecting device alone is formed at least for the positive reception of vertical tensile forces.

WO2017191628 discloses a coupling mechanism configured for readily detachably attaching a first utility module to a second utility module, the coupling mechanism comprising a male coupler at a face of one of the first utility module and the second utility module, and a female coupler at a face of the other one of the first utility module and the second utility module, said female coupler having a depressed locking location configured with at least one locking rib extending above a depressed surface and along a sliding path, and having an open edge facing in a first sense; said male coupler having a projecting locking location disposed in register with said depressed locking location and configured with at least one locking tongue extending along said engaging sliding path at a second sense, opposite to said first sense, and configured for arresting engagement at a space between said locking rib and depressed surface, the coupling mechanism further comprises at least one locking member for arresting the first utility module with respect to said second utility module and preventing sliding displacement along said sliding path.

GENERAL DESCRIPTION

According to the present disclosure, there is provided a crate configured with coupling members rendering it coupleable to other crates or to different types of articulable platforms.

According to an aspect of the disclosure, provided is a crate that has a base and side-walls upwardly extending from the base, of which at least two opposite side-walls are locking side-walls extending parallel to one another. Each of the locking side-walls is configured at a top or a bottom surface thereof with at least one sliding locking slot extending parallel to said locking side-wall and defining a primary sliding path. The at least one sliding locking slot is configured with at least one arresting rib. Another one of the top or a bottom surface of the locking side-walls is configured with at least one locking tongue disposed parallel to said locking side-wall and configured for sliding arresting with a respective locking slot, and a third wall, extending between the two parallel locking side-walls, is configured at one of a top end and a bottom end with a locking latch. The locking latch is slidingly displaceable, normal to said primary sliding path, between a retracted position and a projecting position, wherein at the projecting position it is configured for engaging a latch arresting portion of another one of a top end and a bottom end of a third wall edge of a top or bottom crate, respectively.

The disclosure is such that the sliding locking slots constitute sliding female coupling members, and the locking tongues constitute male coupling members of a male-female coupling system, wherein the one or more male coupling member is configured for engaging a female coupling member, such that sliding the male coupling member into the female coupling member along a sliding path causes the male coupling member to be arrested by the female coupling member, thus causing coupling therebetween.

At a stacked position, where the crate is mounted over a second, like crate, the locking latch is engageable with the latch arresting portion, thereby preventing sliding displacing the crate along the primary sliding path, as a consequence of which the crate cannot detach from the second crate.

At the stacked position, the base edges of a top crate configured with locking tongue male projections, engage with the female type locking slots configured at the top edges of the bottom crate, slidably engageable along said primary sliding path and arrested in a vertical sense, i.e. prevented from separating from one another, wherein the locking latch prevents sliding displacement of the crates, so that the stacked crates are securely stacked and engaged with one another.

The crate can further be configured with an auxiliary coupling arrangement for sliding articulating the crate to another object (crate or any other object). The auxiliary coupling arrangement can be configured on an outside face of one or more of any of the side-walls of the crate and on the base of the crate.

According to one example of the disclosure, the auxiliary coupling arrangement comprises one or more male-female slider coupler type elements on one or more of side-walls of the crate.

According to another example of the disclosure, the auxiliary coupling arrangement comprises one or more male-female slider coupler type elements on an outside face the base.

A crate according to the disclosure can be configured with an auxiliary coupling arrangement on one or more side-walls and on the base.

According to specific examples of the disclosure, the crate is configured with one or more auxiliary male coupling members for sliding coupling engagement with a female coupling member of a male-female slider coupler, the auxiliary male coupling member having a female-engaging portion projecting from an outside face of the crate and comprising at least one locking tongue projecting laterally outwardly from the female-engaging portion, the auxiliary male coupling member being configured for sliding engagement with one or more inwardly-directed arresting ribs of a female coupling member of the object, wherein coupling engagement takes place along an auxiliary sliding path.

The auxiliary sliding path can extend parallel to or normal to the primary sliding path of the crate.

The one or more auxiliary male coupling member is configured for engaging a female coupling member, such that sliding the auxiliary male coupling member into the female coupling member along a sliding path causes the male coupling member to be arrested by the female coupling member, thus causing coupling between first and second objects (e.g. a couple of crates or a crate to another object).

The second object can be a mounting platform articulated to any stationary or mobile member, e.g. a wall, floor, ceiling of a structure or a vehicle, hand truck and the like, disposed vertically or horizontally, and configured with one or more female couplers elements of a male-female coupling.

The female coupling member comprising a depressed locking location defined in a surface of a second object, said depressed locking location defined by surface boundaries, said depressed locking location defining said auxiliary sliding path extending between a male coupling member insertion end and a male coupling member arresting end, and configured with at least one arresting rib laterally inwardly extending from the surface boundaries, the female coupling member being configured for slidingly receiving a male coupling member along the auxiliary sliding path.

The coupling being such that once engagement between the male and female coupling members takes place (namely when the one or more locking tongues and the corresponding one or more respective arresting ribs are engaged), vertical separation between the first and second objects is prevented (i.e. preventing lifting of the first from the second object).

Any one or more of the following features designs and configurations can be incorporated in a crate according to any of the aspects of the present disclosure, independently or at various combinations thereof:

The crate can be rectangular, with the two locking side-walls being left and right side-walls of the crate, and the third wall being a front or a rear side-wall of the crate;

At least the locking side-walls of the crate extend to the same height from the base of the crate;

The third wall can be shorter than the two locking side-walls;

A base portion of the crate, below the third wall, can have a downwardly extending portion for concealing a gap between stacked crates, at the event of a shorter third wall;

A back wall of the crate can extend substantially the same height as the two locking side-walls;

The at least one arresting rib of the sliding locking slots can extend flush with a top or bottom surface, respectively, of a locking side-wall;

The locking tongues can be disposed below or substantially flush with a bottom surface of the crate;

The locking latch can be normally biased into its projecting position;

The locking latch can be manually displaceable between its respective retracted position and projecting position;

The locking latch can be received within a latch space extending between a double walled cavity, with an opening formed at an external wall surface of said latch space for accessing a latch manipulating portion of said locking latch, for manipulating the latch into its retracted position;

The locking latch can extend from a bottom end of the third wall and be configured for engaging with a latch arresting portion at a top of a third wall of a second crate below said crate;

The latch arresting portion can be an inside wall surface of the third wall of the second object or second crate;

A top surface of the locking side walls is configured with one or more protuberances. The protuberances can be configured with a substantially upright outside facing surface and an inclined inside facing surface; the protuberances can be configured for engaging within depressions disposed in register at a bottom surface of a like-crate stacked above, to thereby prevent outwards buckling of the locking side walls of a bottom crate;

The locking latch and the latch arresting portion can be configured at a front wall of the crate, where the primary sliding path extends between the front wall to a rear wall of the crate;

A gliding ramp portion is configured at the third wall, for guidance of the locking latch into latch arresting portion;

The crate can be configured with carrying handles at an outside wall surface of at least at two opposite side-walls;

The third face of the crate can be configured with a manipulating handle; the manipulating handle can be fixed or pivotally articulated to the crate.

The manipulating handle can be disposed within finger reach from the locking latch manipulating portion;

The locking latch manipulating portion can be manipulated using a single finger of a hand, whilst simultaneously holding the manipulating handle;

The locking latch can be configured for normally projecting from a bottom face of the crate, whereby one or more protecting seat members are provided, extending at least at the vicinity of the locking latch to an extent substantially similar to a projecting length of the locking latch;

The crate can be configured with a cover. The cover an be pivotally or slidingly secured to the crate;

The cover can be configured with one or more auxiliary male-female coupling members;

The auxiliary coupling arrangement can be configured with one or more support female coupling elements, in addition to the auxiliary male coupling member, extending along the auxiliary sliding path, for sliding engaging with respective one or more support male coupling elements projecting from the other object, thereby reinforcing articulation of the crate to the other object;

The crate can be a container of any type, size and shape.

The crate can be mounted on a mounting member with the crate opening oriented at any direction. The following are crate mounting examples:

the crate can be articulated to a ceiling mounted plate, at a suspended fashion, through coupling of the locking side-walls to the ceiling mounted plate, with the crate's opening facing the ceiling (i.e. facing upwards);

the crate can be articulated to a ceiling mounted plate, at a suspended fashion, through an auxiliary coupling arrangement configured at an outside wall of the crate (i.e. with the crate's base extending substantially normal to the ceiling and the crate's opening facing a wall);

the crate can be articulated to a surface mounted plate fixed to any bearing surface, through an auxiliary coupling arrangement configured at the base of the crate, (i.e. with the crate's opening facing substantially upwards, normal to said surface mounted plate);

the crate can be articulated to a wall mounted plate (e.g. vertically extending mounting plate), through an auxiliary coupling arrangement configured on an outside face of one or more of any of the side-walls of the crate at an outside wall of the crate (i.e. with the crate's base extending substantially normal to the wall mounted plate and the crate's opening facing a ceiling); and/or the crate can be articulated to a wall mounted plate (e.g. vertically extending mounting plate), through an auxiliary coupling arrangement configured on base of the crate (i.e. with the crate's base extending substantially parallel to the wall mounted plate and the crate's opening facing sideward).

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1A:
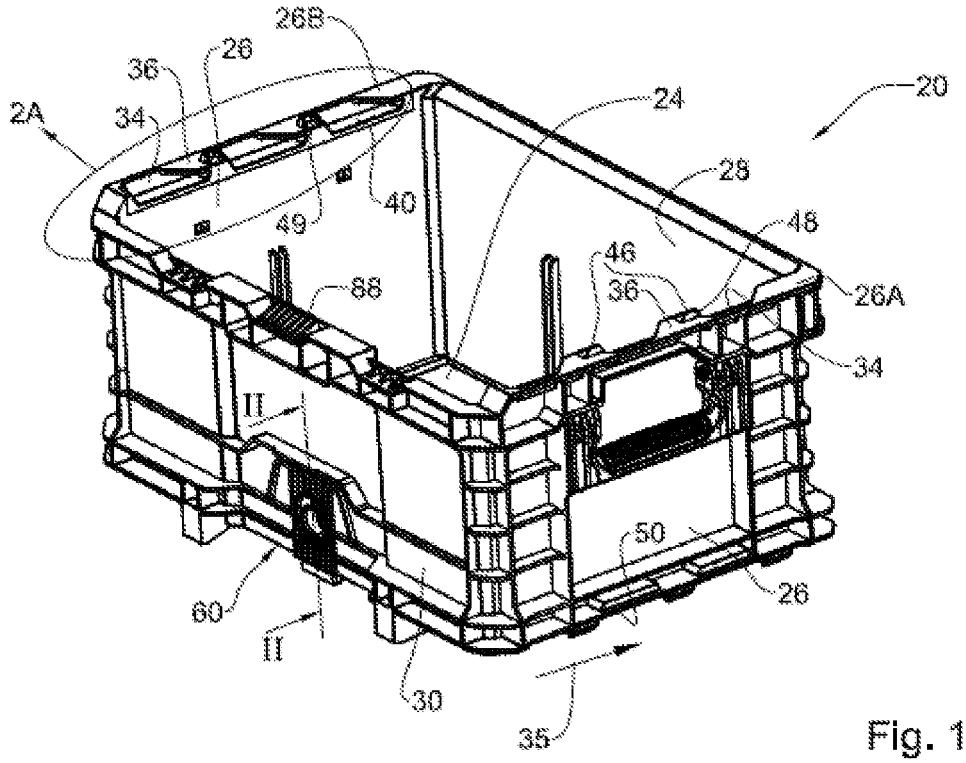
FIG. 1A is a top perspective view of a crate according to an example of the disclosure.
Figure 1B:
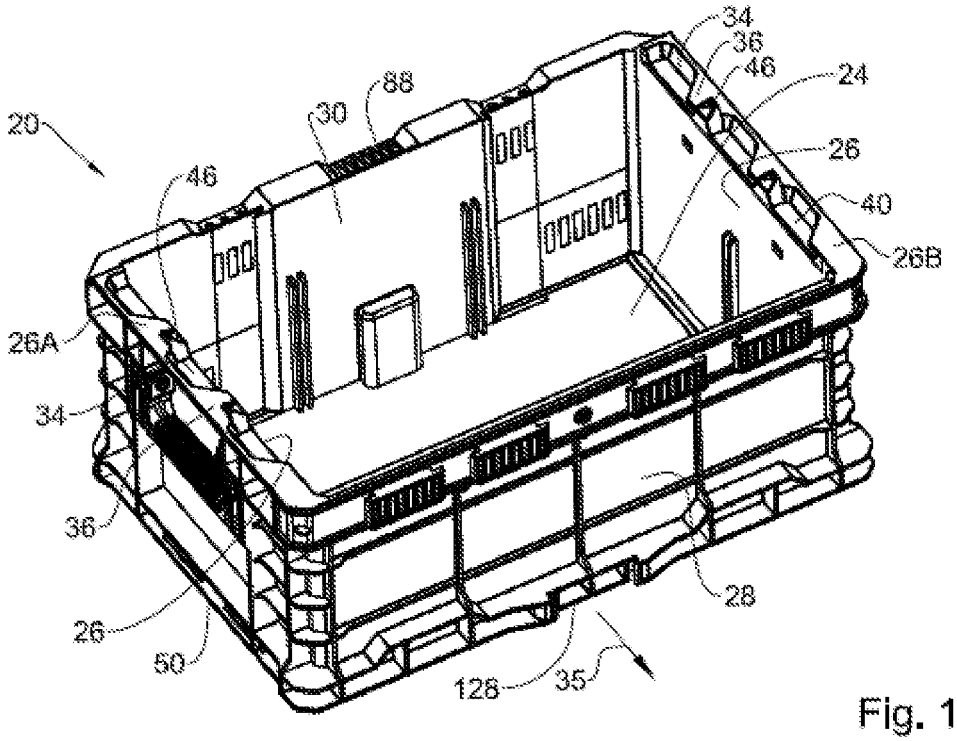
FIG. 1B is a rear perspective view of the crate of FIG. 1A.
Figure 1C:
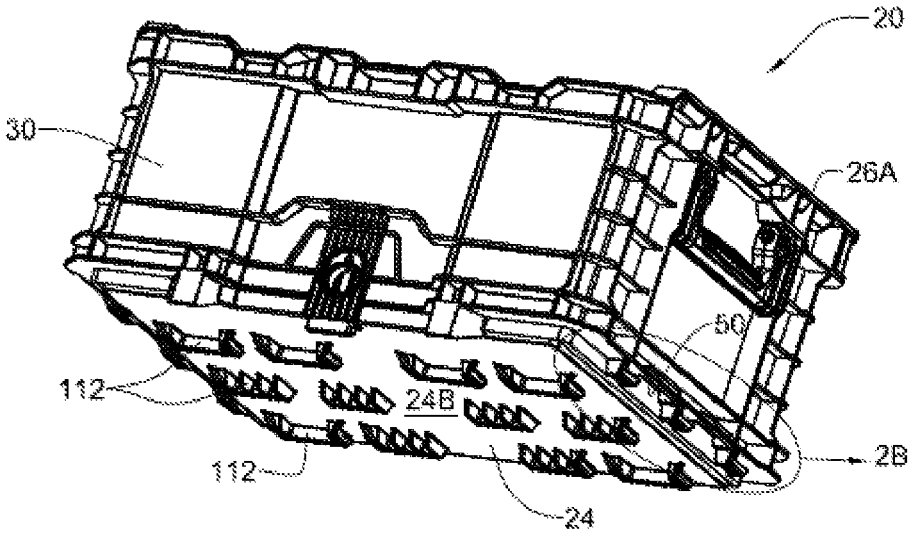
FIG. 1C is a bottom perspective view of the crate of FIG. 1A.
Figure 1D:
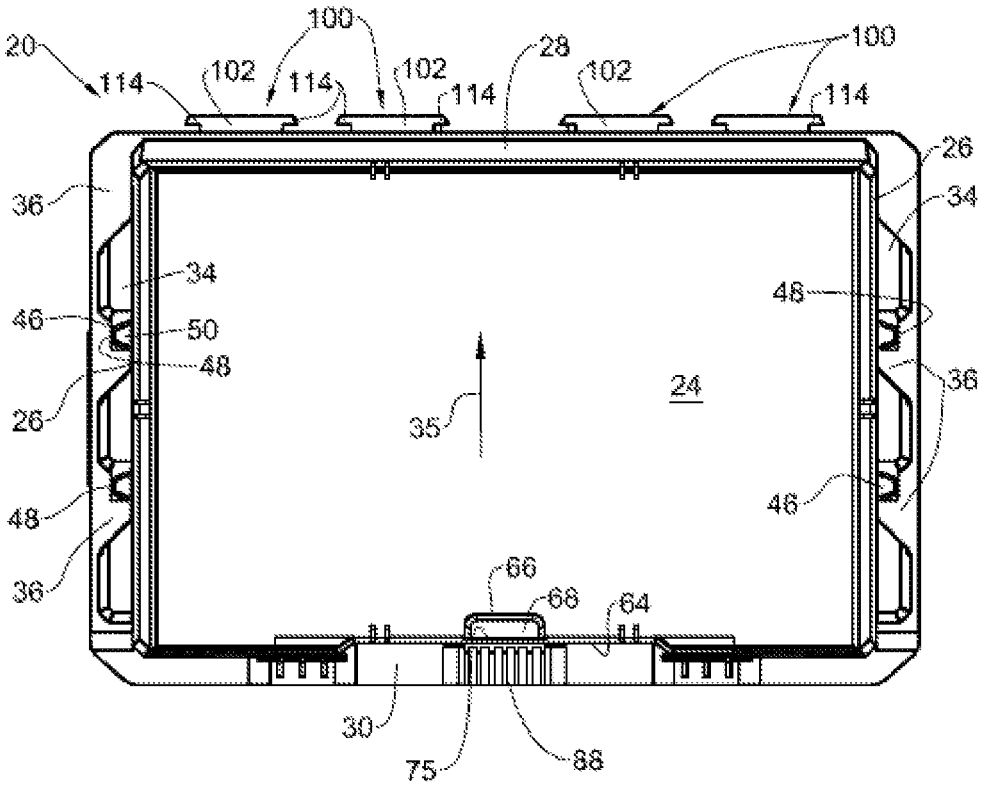
FIG. 1D is a top planar view of the crate of FIG. 1A.

Attention is first directed to FIGS. 1A to 2C, directed to a crate according to the present disclosure, generally designated 20. The crate 20 is a rectangle shaped open top crate, made of molded resin and comprises a base 24 from which four side-walls upwardly extend, of which two opposite side-walls are referred to as locking side-walls 26, a back wall 28 extending at a rear of the crate, between the locking side-walls 26, and a front wall, between the locking side-walls 26, referred to as a third wall 30.

The two locking side-walls 26 are each configured at their top faces 26A and 26B, respectively, with three female coupling depressions, namely sliding locking slots 34, disposed parallel and along the top face of each locking side-wall 26, and each slot configured with an arresting rib 36, a top surface thereof extending substantially flush with the top faces 26A and 26B, respectively, such that the arresting rib 36 forms an undercut portion 38 therebelow (best seen in FIG. 2A), for arresting a respective coupling male member as will be discussed hereinafter. It is further seen that each of the sliding locking slots 34 is configured with an uncovered portion extending behind arresting rib 36, serving as a receiving bay 40 for a male coupling tongue, as will follow. The sliding locking slots 34 constitute female coupling members of a male-female coupling system.

The sliding locking slots are disposed parallelly along a sliding path (also referred to as an engaging path) extends in direction from the third wall 30 to the back wall 28, as represented by arrow 35.

Also extending from the top faces 26A and 26B, respectively, there are protuberances 46 (two disposed on each side-wall), said protuberances configured with a substantially upright outside-facing surface 48 and an inclined inside-facing surface 49. The purpose of said protuberances 46 will become apparent upon discussing stacking of crates.

The crate 20 is further configured, at each bottom surface 50 of the locking side-walls 26A and 26B, with several locking tongues 54 (three in the illustrated example in correspondence with the three sliding locking slots 34), parallelly extending and disposed along said sliding path 35. Each of the locking tongues 54 is open in a direction facing the back wall, with a space 37 above each tongue, wherein the shape and size of each locking tongues 54 is configured for receiving within the receiving bay 40 namely sliding locking slots 34, and further for sliding engagement with the arresting rib 36, wherein the locking tongues 54 constitute male coupling members of a male-female coupling system. The space 37 is sufficient for receiving the arresting rib 36.

Figure 2A:
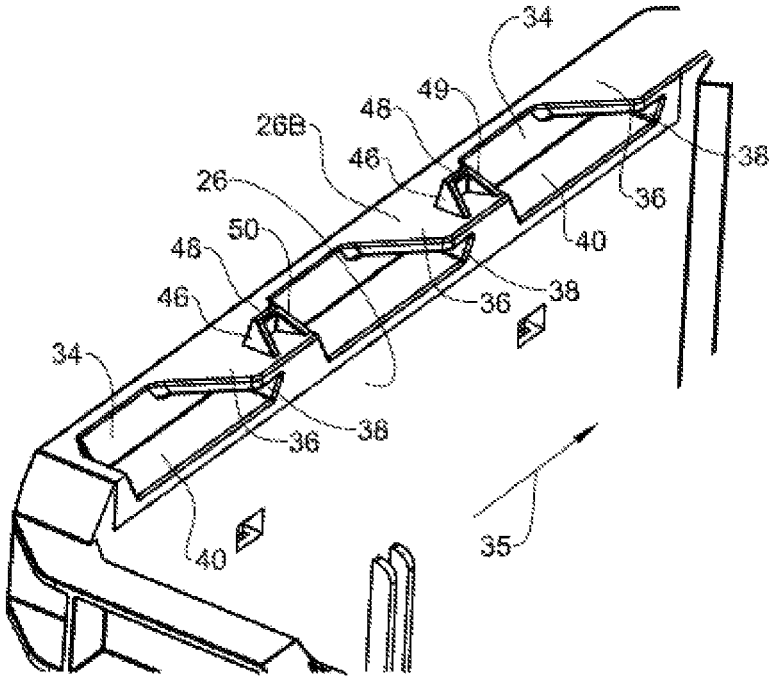
FIG. 2A is an enlargement of the portion marked 2A in FIG. 1A.
Figure 2B:
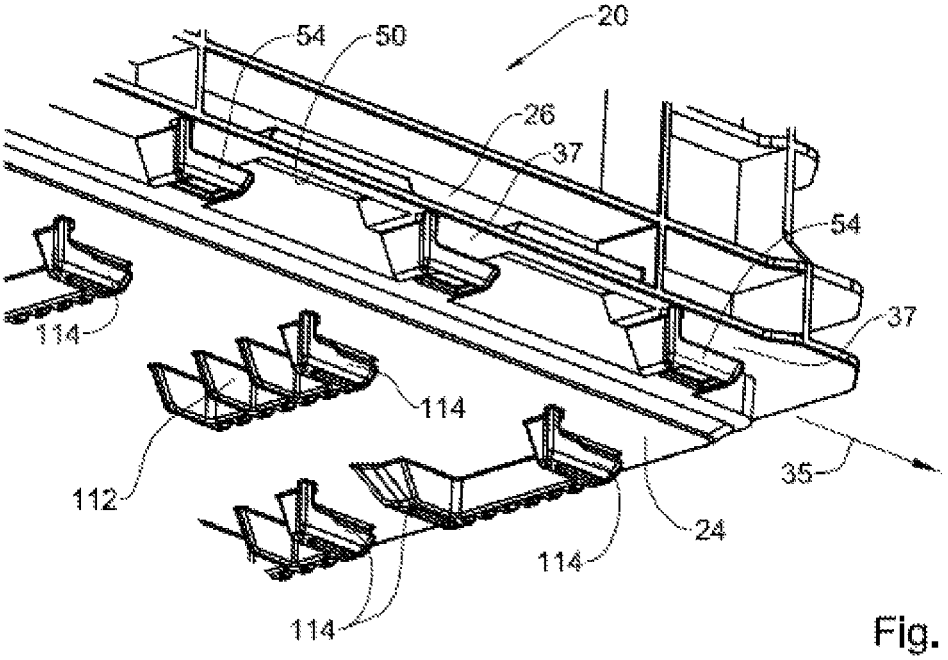
FIG. 2B is an enlargement of the portion marked 2B in FIG. 1C.
Figure 2C:
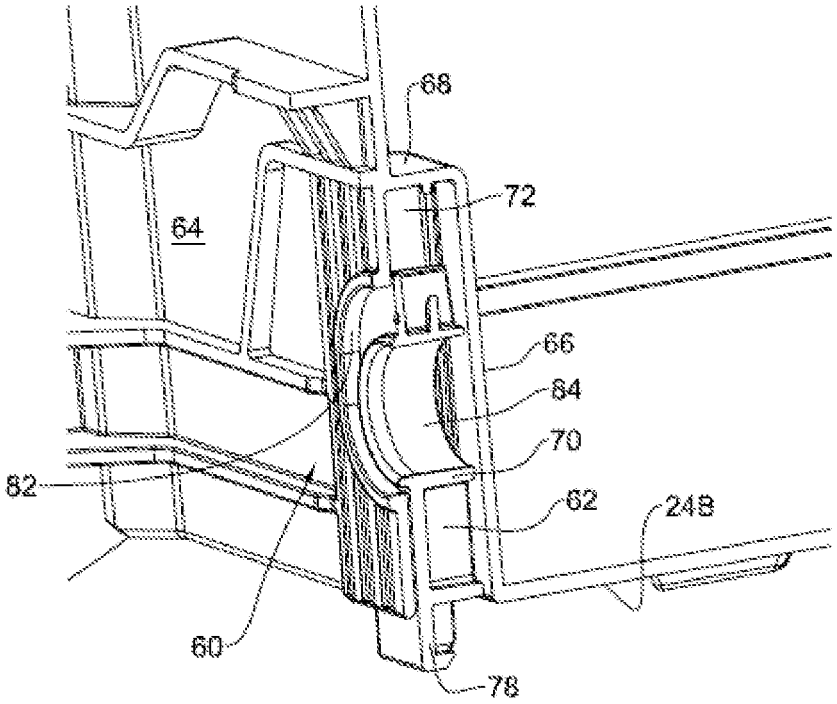
FIG. 2C is an enlarged sectioned view of a portion along line II-II in FIG. 1B.

Further configured at a bottom of the third wall 30 of crate 20, there is a locking latch assembly 60 comprising a double walled cavity 62 extending between an external wall surface 64 of the third wall 30, and an inside wall surface 66 thereof, with an inside-protruding housing 68 within the inside space of the crate. The locking latch assembly 60 comprises a locking latch 70, biased by a biasing member 72 within the cavity 62, such that a locking tip 78 of the locking latch 70 normally projects from bottom surface 24B of bottom wall 24 (FIG. 2C). The external wall surface 64 of the third wall 30 is configured with a window 82 allowing access to a manipulating recess 84 of the locking latch 70, facilitating manual manipulating thereof between the normally projecting position (engaged, locked position), and a temporarily axially displaced position, wherein the locking tip 78 is flush or above the bottom face of the bottom wall 24 (disengaged, unlocked position). The arrangement is such that at the projecting position the locking tip 78 is configured for bearing against an inside wall surface 30B of the third wall 30 (FIG. 3C).

As will become apparent hereafter, the object of the locking latch assembly 60 is to prevent sliding displacement of a top, stacked crate, over a bottom crate along said sliding path 35, whilst the male-female coupling members provide articulation of the stacked crates so as to prevent their separation in a vertical direction.

Figure 3A:
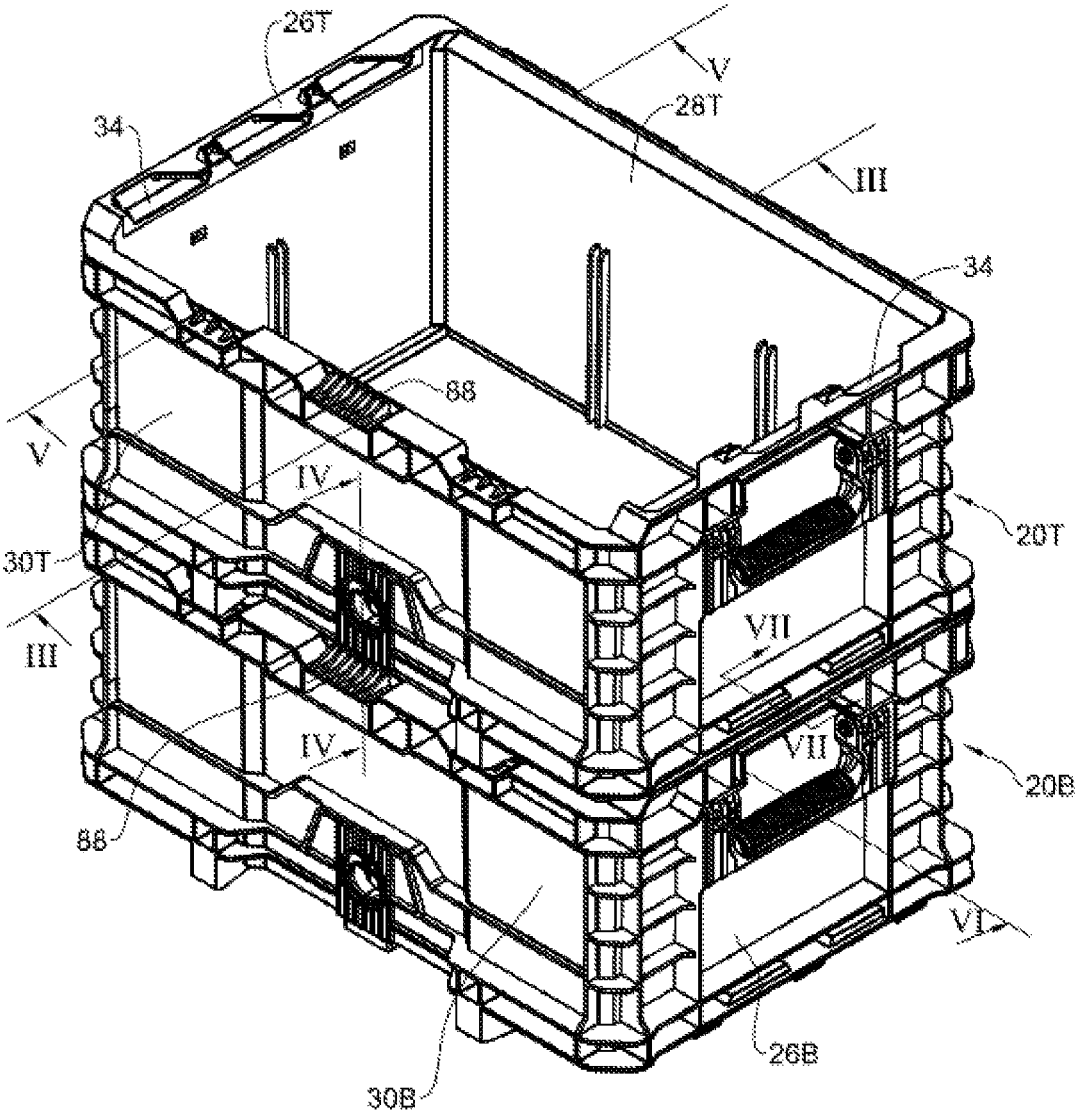
FIG. 3A is a perspective view of a stack of two crates according to the present disclosure.
Figure 3B:
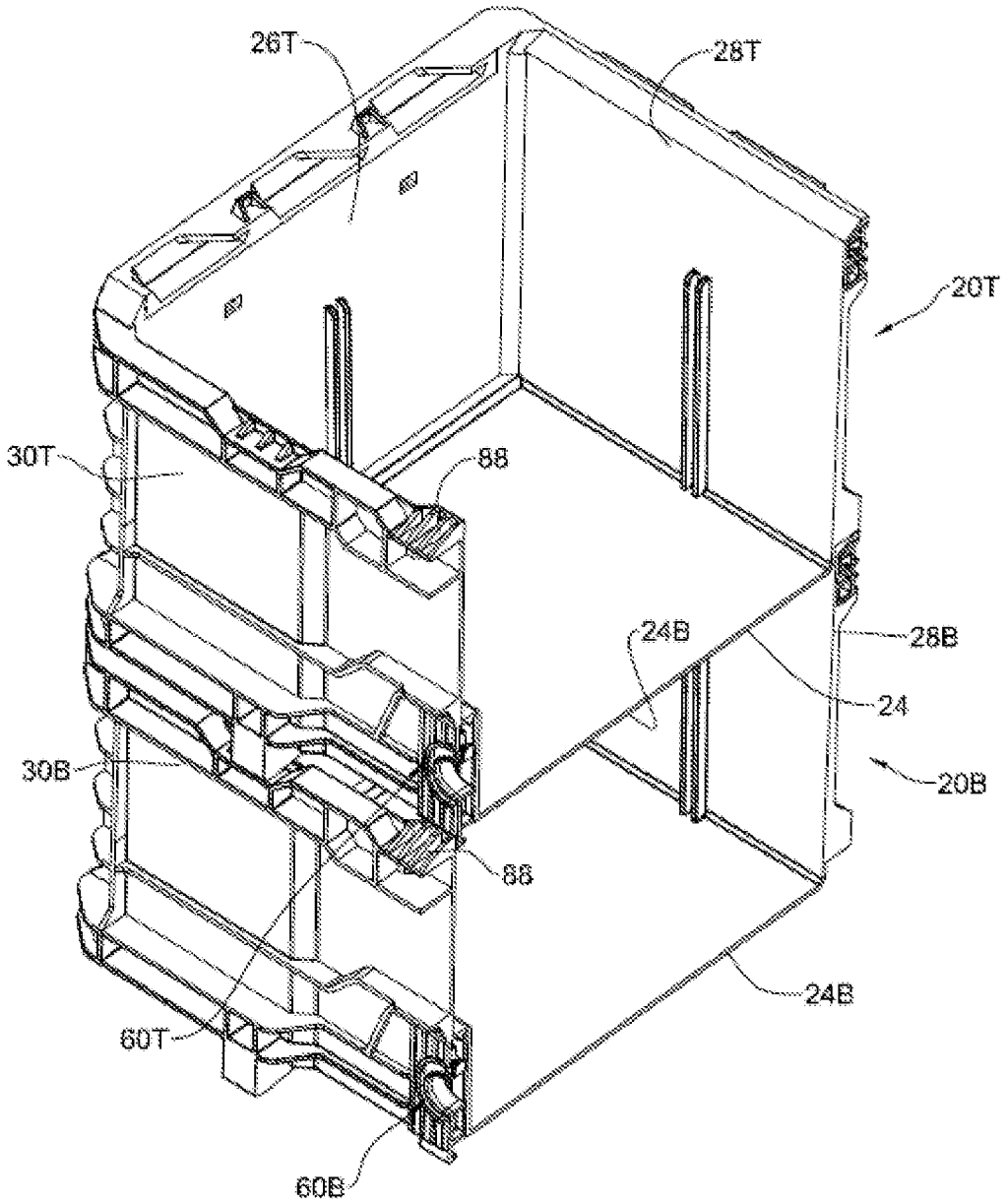
FIG. 3B is a sectioned view along line III-III in FIG. 3A.
Figure 3C:
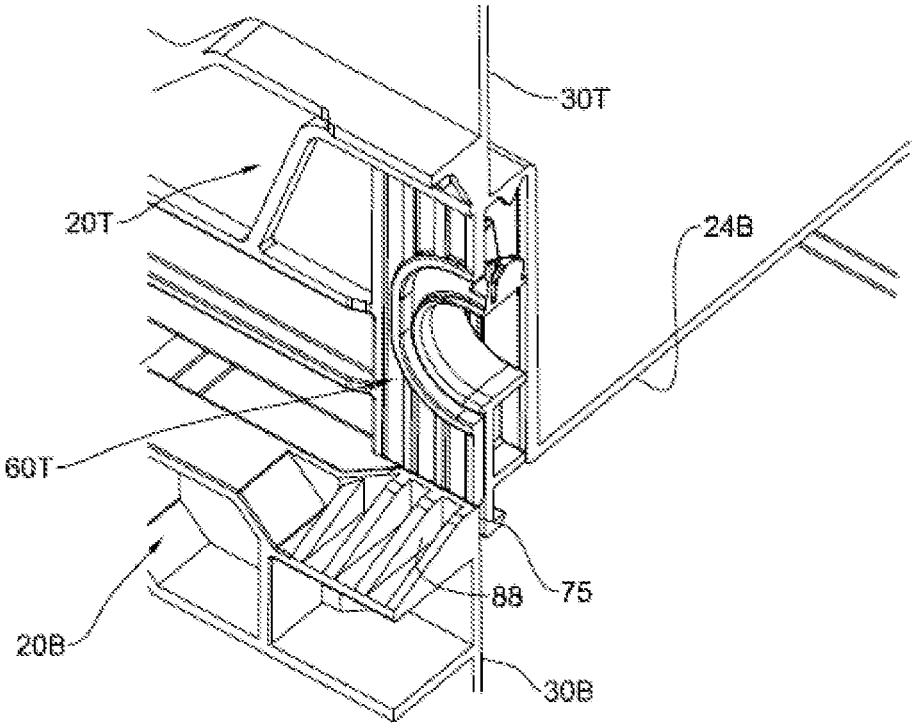
FIG. 3C is an enlarged sectioned view of a portion along line IV-IV in FIG. 3A.
Figure 3D:
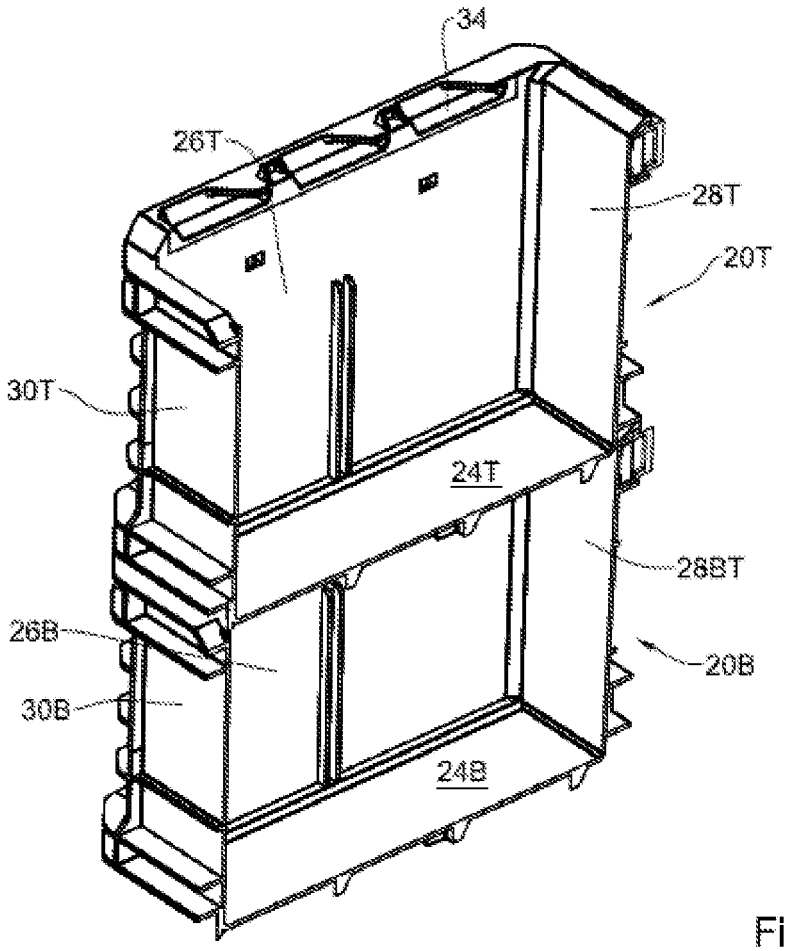
FIG. 3D is section along line V-V in FIG. 3A.
Figure 3E:
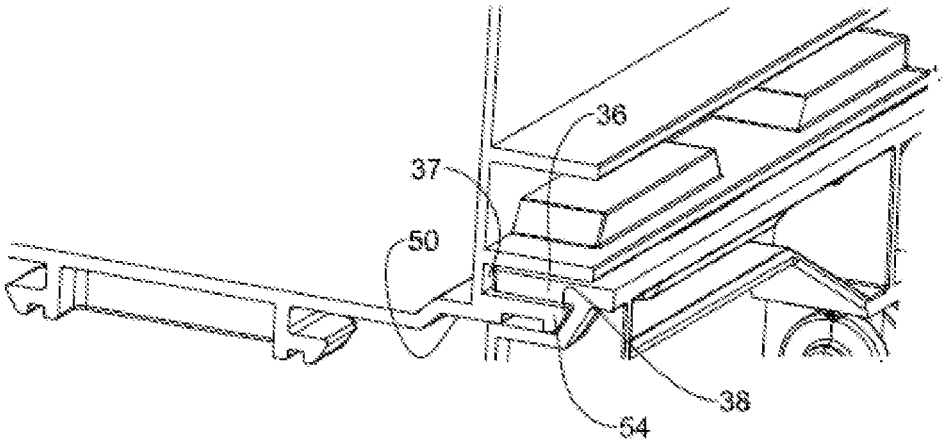
FIG. 3E is section along line VI-VI in FIG. 3A.
Figure 3F:
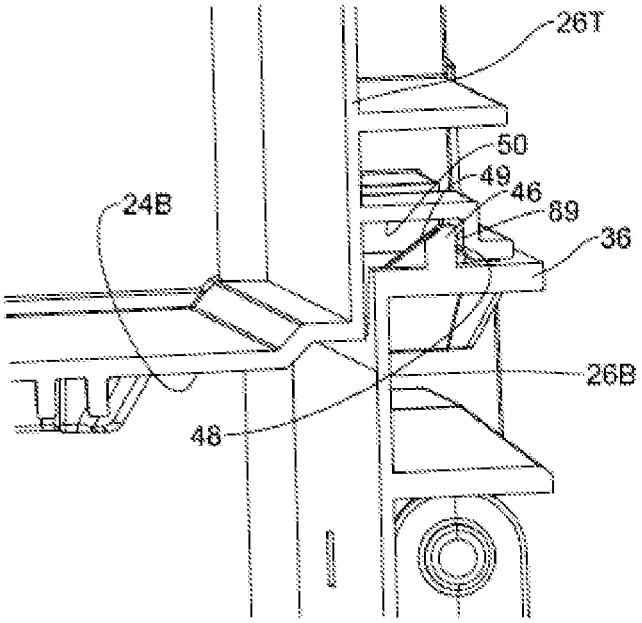
FIG. 3F is section along line VII-VII in FIG. 3A.
Figure 4A:
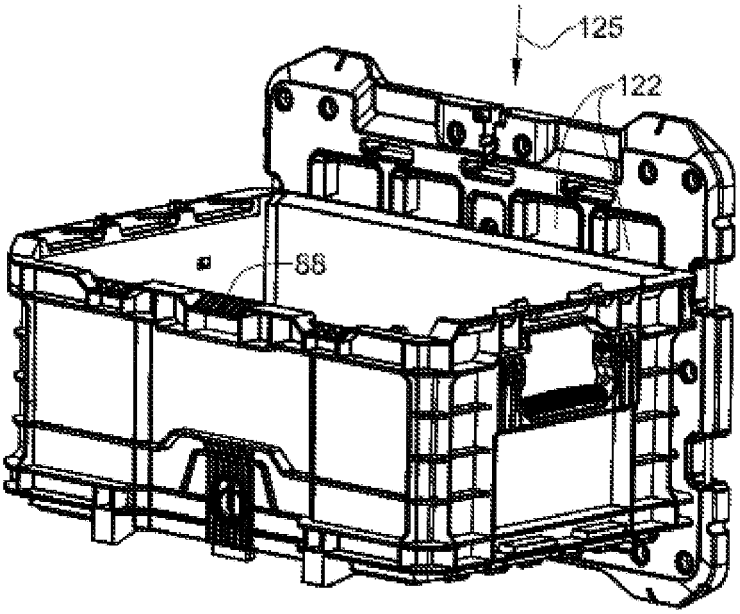
FIG. 4A is a perspective front view of a crate according to the disclosure, articulated to a wall mounting plate, through an auxiliary coupling.
Figure 4B:
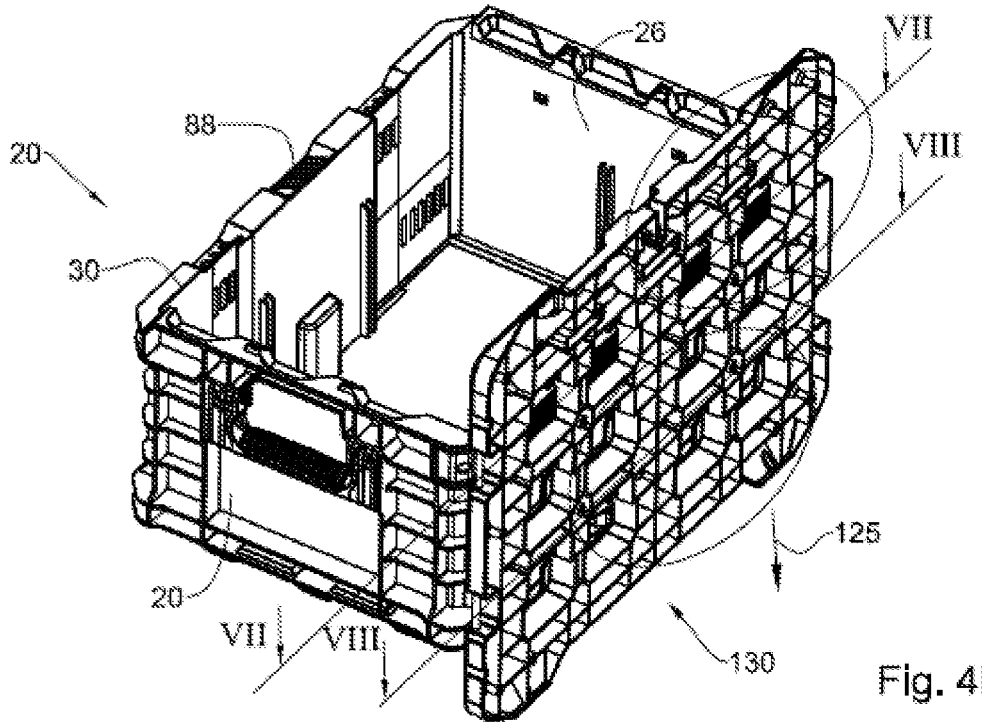
FIG. 4B is a perspective rear view of the assembly of FIG. 4A.
Figure 5:
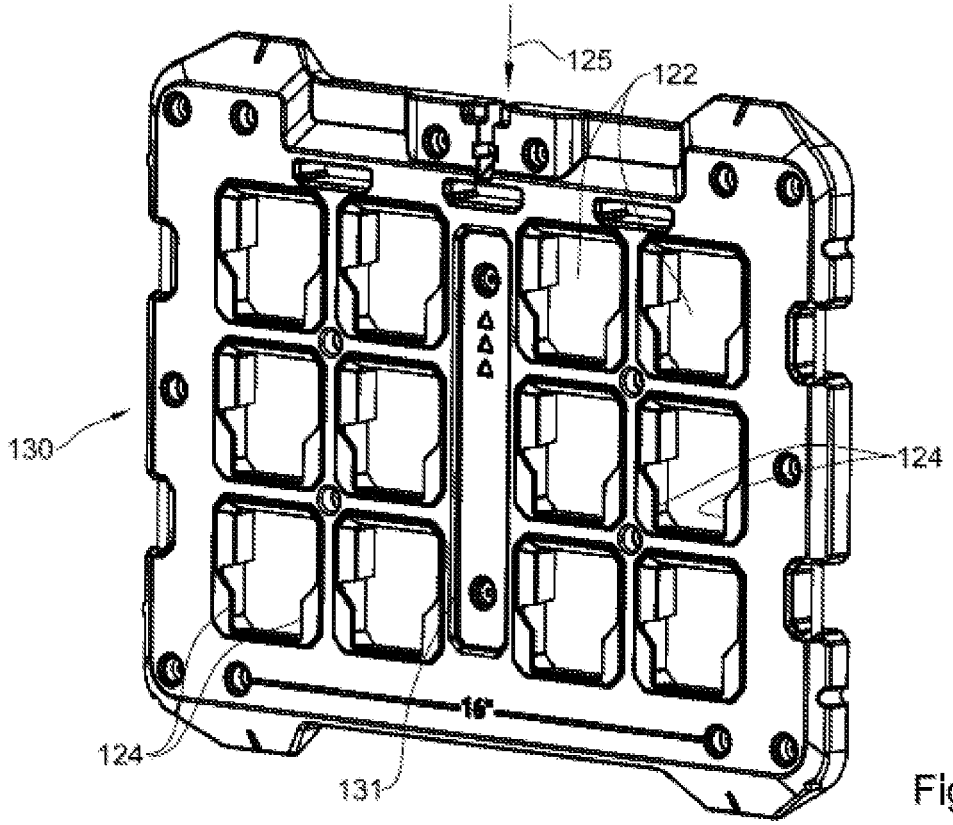
FIG. 5 is perspective view of the wall mounting plate of FIG. 4A.
Figure 6A:
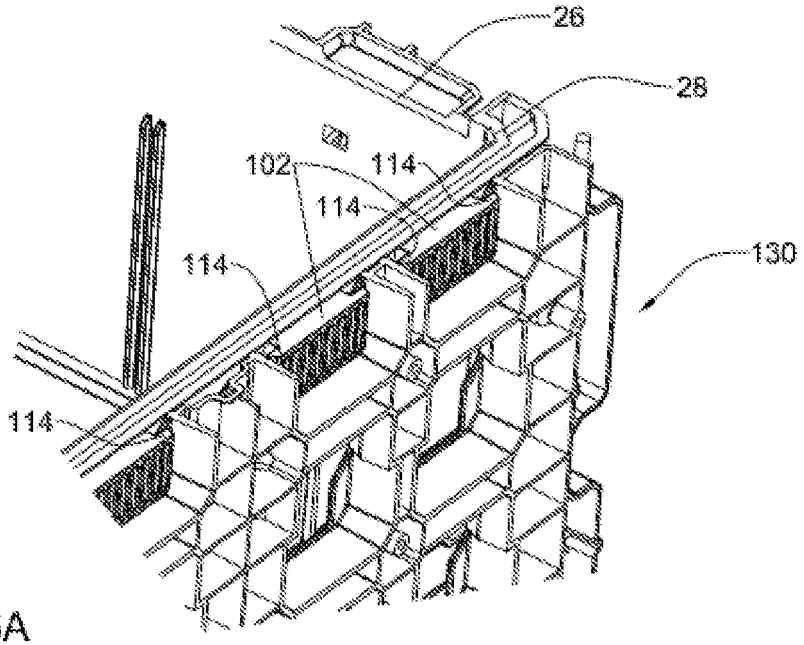
FIG. 6A is an enlarged section along line VII-VII in FIG. 4B.
Figure 6B:
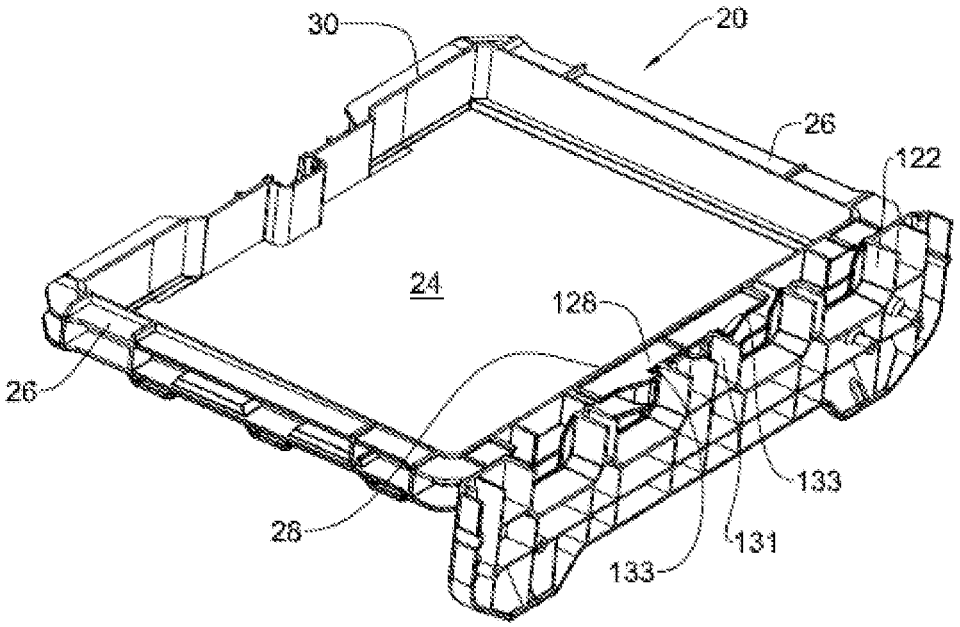
FIG. 6B is an enlarged section along line VIII-VIII in FIG. 4B.

At a top end of the third wall 30, at a location above the locking latch assembly 60, there is a ribbed gliding ramp 88 configured for guidance of the locking latch into latch arresting portion, namely at the location 75 (FIGS. 1D and 3C) bearing against the inside wall surface 30B of the third wall 30 (FIG. 3C).

Further reference is now being made also to FIGS. 3A to 3F, showing stacking of two crates above one another, the two crates being similar to one another and are the same as crate 20 illustrated herein, and are designated 20T (top crate) and 20B (bottom crate), respectively. Likewise, the respective elements of these crates are given like reference numbers as above, however annotated T and B to indicate Top and Bottom, respectively.

For stacking the crates, the top crate 20T is placed over the bottom crate 20B at a partially overlapping position, such that the locking side-walls 26T of the top crate are coplanar with the locking side-walls 26B of the bottom crate, however with the third wall 30T of the top crate disposed slightly before the third wall 30B of the bottom crate, allowing the locking tongues 54 of the top crate to nest within the receiving bay 40. Then, the top crate 20T is slidingly displaced forwards, i.e. along the sliding path 35, namely towards the back wall 28, whereupon the as the locking tongues 54 engage under the arresting ribs 36 the locking tip 78 of locking latch 70 of the top crate slides over the gliding ramp 88, causing the locking latch 70 to temporarily retract and facilitating further sliding displacement of the top crate 20T over the bottom crate 20B, until the containers are flush on top of one another (FIGS. 3A-3F), whereby the locking latch 70 can spontaneously displace into its normally projecting position and engage the latch arresting portion 75 (at the inner surface of the third wall 30B of the bottom crate 20B). Once coupled, the crates 20T and 20B are securely articulated to one another and will not detach unless the locking latch 70 of the top crate is displaced to retract, facilitating sliding displacement of the top crate along the sliding path, though at a reverse sense, whereby the crates are no uncoupled.

Reverting now to the protuberances 46 extending from the top faces 26A and 26B, respectively (of the bottom crate 20B), these are configured for engaging within an upright wall surface 89 of a depression disposed in register at a bottom surface of the top crate 20T stacked above, to thereby prevent outwards buckling of the locking side-walls 26B of a bottom crate 20B, as might have occurred under load.

According to another aspect of the present disclosure, and with further reference now being made also to FIGS. 4A to 6B, the crate 20 is further configured with an auxiliary coupling arrangement. The auxiliary coupling arrangement comprises a first auxiliary coupling arrangement 100 (best seen in FIG. 1D) configured at outside face of the back wall 28 of the crate, and a second auxiliary coupling arrangement 110 configured at the bottom face of the base 24 of the crate.

Whilst the a first auxiliary coupling arrangement 100 is configured only on the back wall 28, it is appreciated that it could just as well be configured on any other side-wall of the crate. Furthermore, the crate 20 can exclude any auxiliary coupling arrangement, or it can be configured with any one or more of the first auxiliary coupling arrangement 100 and the second auxiliary coupling arrangement 110.

Both the first auxiliary coupling arrangement 100 and the second auxiliary coupling arrangement 110 are configured with a plurality of male coupling members 102 and 112, respectively, of male-female slider coupler type arrangements. The auxiliary male coupling members 102 and 112 are configured for sliding coupling engagement with corresponding female coupling members 122 of a male-female slider coupler, e.g. of a mounting plate 130 (best seen in FIG. 5). The auxiliary male coupling members 112 and 122 are configured with a female-engaging portion projecting from an outside face of the crate and comprising at least one (two in the illustrations) locking tongues 114 projecting laterally outwardly from the female-engaging portion, and configured for sliding engagement with inwardly-directed arresting ribs 124 of the female coupling members 122 of the mounting plate 130, wherein coupling engagement takes place along an auxiliary sliding path 125.

In addition, the back wall 28 is configured with a female coupler member 128 (best seen in FIG. 1B), for sliding arresting (along said sliding path 125) with a corresponding male coupling member 131 being an elongate member configured with two laterally projecting coupling ribs 133.

The male-female coupling array disposed on the mounting plate 130 and the first auxiliary coupling arrangement 100 and the second auxiliary coupling arrangement 110 of the crate 20 are disposed so as to facilitate mounting of the crate to the mounting plate 130 either through the first auxiliary coupling arrangement 100 or through the second auxiliary coupling arrangement 110.

It is thus appreciated that the crate 20 can be mounted on a mounting member 130 with the crate opening oriented at any direction. The following are crate mounting examples:

- the crate can be articulated to a ceiling mounted plate, at a suspended fashion, through coupling of the locking side-walls to the ceiling mounted plate, with the crate's opening facing the ceiling (i.e. facing upwards);
- the crate can be articulated to a ceiling mounted plate, at a suspended fashion, through an auxiliary coupling arrangement configured at an outside wall of the crate (i.e. with the crate's base extending substantially normal to the ceiling and the crate's opening facing a wall);
- the crate can be articulated to a surface mounted plate fixed to any bearing surface, through an auxiliary coupling arrangement configured at the base of the crate, (i.e. with the crate's opening facing substantially upwards, normal to said surface mounted plate);
- the crate can be articulated to a wall mounted plate (e.g. vertically extending mounting plate), through an auxiliary coupling arrangement configured on an outside face of one or more of any of the side-walls of the crate at an outside wall of the crate (i.e. with the crate's base extending substantially normal to the wall mounted plate and the crate's opening facing a ceiling); and the crate can be articulated to a wall mounted plate (e.g. vertically extending mounting plate), through an auxiliary coupling arrangement configured on base of the crate (i.e. with the crate's base extending substantially parallel to the wall mounted plate and the crate's opening facing sideward).

The invention claimed is:

1. A crate having a base and side-walls upwardly extending from the base, of which at least two opposite side-walls are locking side-walls extending parallel to one another, each of the locking side-walls is configured at a top or a bottom surface thereof with at least one sliding locking slot extending parallel to said locking side-wall and defining a primary sliding path; said at least one sliding locking slot is configured with at least one arresting rib and an uncovered portion extending behind the at least one arresting rib;

another one of the top or a bottom surface of the locking side-walls is configured with at least one locking tongue disposed parallel to said locking side-wall and configured for sliding arresting with a respective locking slot, the at least one sliding locking slot serving as a receiving bay for the at least one locking tongue, and the at least one locking tongue having a length that is parallel to the locking side wall that is shorter than a length of the receiving bay that is parallel to the locking side wall; and a third wall, extending between the two parallel locking side-walls, is configured at one of a top end and a bottom end with a locking latch, slidingly displaceable, normal to said primary sliding path, between a retracted position and a projecting position, wherein at the projecting position it is configured for engaging a latch arresting portion of another one of a top end and a bottom end of a third wall edge of a top or bottom crate, respectively.

2. The crate of claim 1, wherein the sliding locking slots constitute sliding female coupling members of one object, and the locking tongues constitute male coupling members of a male-female coupling system of another object, wherein the male coupling member is configured for engaging a female coupling member such that sliding the male coupling member into the female coupling member along a sliding path causes the male coupling member to be arrested by the female coupling member, thus causing coupling between the one object and the other object.

3. The crate of claim 1, wherein at a stacked position, where the crate is mounted over a second, like crate, the locking latch is engageable with the latch arresting portion thereby preventing sliding displacing the crate along the primary sliding path, as a consequence of which the crate cannot detach from the second crate.

4. The crate of claim 3, wherein at the stacked position, base edges of a top crate configured with locking tongue male projections, engage with female type locking slots configured at the top edges of the bottom crate, slidably engageable along said primary sliding path and arrested in a vertical direction, wherein the locking latch prevents sliding displacement of the crates, so that the stacked crates are securely stacked and engaged with one another.

5. The crate of claim 1, comprising one or more features selected from the group consisting of: (i) the crate is rectangular, with the two locking side-walls being left and right side-walls of the crate, and the third wall being a front or a rear side-wall of the crate, (ii) at least the locking side-walls of the crate extend to the same height from the base of the crate, (iii) the third wall is shorter than the two locking side walls, and wherein a base portion of the crate, below the third wall is configured with a downwardly extending portion for concealing a gap between stacked crates, at the event of a shorter third wall, and (iv) the at least one arresting rib of the sliding locking slots extends flush with a top or bottom surface, respectively, of a locking side-wall.

6. The crate of claim 1, wherein (i) the locking tongues are disposed below or substantially flush with a bottom surface of the crate, and/or (ii) the locking latch is normally biased into its projecting position.

7. The crate of claim 1, wherein the locking latch has at least one feature selected from (i) being manually displaceable between its respective projecting position and retracted position, and (ii) being received within a latch space extending between a double walled cavity, with an opening formed at an external wall surface of the latch space for accessing a latch manipulating portion of said locking latch, for manipulating the latch into its retracted position.

8. The crate of claim 1, wherein the locking latch extends from a bottom end of the third wall and is configured for engaging with a latch arresting portion at a top of a third wall of a second crate below said crate.

9. The crate of claim 8, wherein the latch arresting portion is an inside wall surface of the third wall of a crate below said crate.

10. The crate of claim 1, wherein the locking latch and the latch arresting portion are configured at a front wall of the crate, where the primary sliding path extends between the front wall to a rear wall of the crate.

11. The crate of claim 1, wherein a gliding ramp portion is configured at the third wall, for guidance of the locking latch into latch arresting portion.

12. The crate of claim 1, wherein carrying handles are configured at an outside wall surface of at least at two opposite side walls.

13. The crate of claim 1, wherein the third wall of the crate is configured with a manipulating handle.

14. The crate of claim 13, wherein (i) the manipulating handle is disposed within finger reach from the locking latch manipulating portion, or (ii) the locking latch is manipulable between the projecting position and the retracted position using a single finger of a hand, whilst simultaneously holding the manipulating handle.

15. The crate of claim 1, wherein the locking latch normally projecting from a bottom face of the crate, whereby one or more protecting seat members are provided, extending at least at the vicinity of the locking latch to an extent substantially similar to a projecting length of the locking latch.

16. The crate of claim 1, wherein a top surface of the locking side-walls is configured with one or more protuberances configured with a substantially upright outside-facing surface and an inclined inside-facing surface; the protuberances are configured for engaging within depressions disposed in register at a bottom surface of a like-crate stacked above, to thereby prevent outwards buckling of the locking side walls of a bottom crate.

17. The crate of claim 1, further configured with an auxiliary coupling arrangement for sliding articulating the crate to another object, wherein the auxiliary coupling arrangement is configured on an outside face of one or more of any of the side walls of the crate and on the base of the crate.

18. The crate of claim 17, wherein (i) the object is a mounting platform articulated to any stationary or mobile member, disposed vertically or horizontally, and configured with one or more female couplers elements of a male-female coupling, or (ii) the auxiliary coupling arrangement comprises one or more male-female slider coupler type elements on an outside face the base of the crate.

19. The crate of claim 17, wherein the auxiliary coupling arrangement comprises one or more male-female slider coupler type elements on an outside face of one or more of the side walls of the crate.

20. The crate of claim 19, wherein (i) an auxiliary sliding path extends parallel to, or normal to a primary sliding path of the crate, (ii) the one or more auxiliary male coupling member is configured for engaging a female coupling member such that sliding the auxiliary male coupling member into the female coupling member along a sliding path causes the male coupling member to be arrested by the female coupling member, thus causing coupling between the crate and the objects, or (iii) wherein the auxiliary coupling arrangement is configured with one or more support female coupling elements, in addition to the auxiliary male coupling member, extending along an auxiliary sliding path, for sliding engaging with respective one or more support male coupling elements projecting from the other object, thereby reinforcing articulation of the crate to the other object.

21. The crate of claim 1, comprising one or more auxiliary male coupling members for sliding coupling engagement with a female coupling member of a male-female slider coupler, the auxiliary male coupling member having a female-engaging portion projecting from an outside face of the crate and comprising at least one locking tongue projecting laterally outwardly from the female-engaging portion, the auxiliary male coupling member being configured for sliding engagement with one or more inwardly-directed arresting ribs of a female coupling member of the object, wherein coupling engagement takes place along an auxiliary sliding path.

22. The crate of claim 21, wherein the female coupling member comprising a depressed locking location defined in a surface of a second object, said depressed locking location defined by surface boundaries, said depressed locking location defining said auxiliary sliding path extending between a male coupling member insertion end and a male coupling member arresting end, and configured with at least one arresting rib laterally inwardly extending from the surface boundaries, the female coupling member being configured for slidingly receiving a male coupling member along the auxiliary sliding path.

* * * * *